US005505453A

United States Patent [19]

Mack

[11] Patent Number: 5,505,453

[45] Date of Patent: Apr. 9, 1996

[54] TUNABLE GOLF CLUB HEAD AND METHOD OF MAKING

[76] Inventor: Thomas E. Mack, 10592 Wolff Dr., Villa Park, Calif. 92667

[21] Appl. No.: 277,738

[22] Filed: Jul. 20, 1994

[51] Int. Cl.[6] ..... A63B 9/36; A63B 53/08

[52] U.S. Cl. ..... 273/186.2; 273/193 R; 273/78; 273/167 H; 273/173

[58] Field of Search ..... 273/167 R, 78, 273/193 R, 194 R, 194 A, 186.2, 187.4, 186.1, 167 J, 167 H, 79, 173, 169–172

[56] References Cited

U.S. PATENT DOCUMENTS

| | | | |
|---|---|---|---|
| 769,939 | 9/1904 | Clark | 273/78 |
| 1,039,491 | 9/1912 | Collins | 273/78 |
| 2,111,249 | 3/1938 | Plese | 273/78 |
| 4,067,572 | 1/1978 | Coleman . | |
| 4,432,549 | 2/1984 | Zebelean . | |
| 4,618,149 | 10/1986 | Maxel . | |
| 4,884,808 | 12/1989 | Retzer . | |
| 4,884,812 | 12/1989 | Nagasaki et al. . | |
| 4,928,972 | 5/1990 | Nakanishi et al. . | |
| 4,930,781 | 6/1990 | Allen . | |
| 4,988,104 | 6/1991 | Shiotani et al. . | |
| 5,064,197 | 11/1991 | Eddy . | |
| 5,316,304 | 5/1994 | Yost | 273/168 |
| 5,332,214 | 7/1994 | Tucker | 273/78 |
| 5,364,103 | 11/1994 | Chen | 273/193 R |

FOREIGN PATENT DOCUMENTS

| | | | |
|---|---|---|---|
| 46269518 | 9/1994 | Japan | 273/78 |
| 1891 | 1/1904 | United Kingdom | 273/78 |
| 23845 | 10/1906 | United Kingdom | 273/78 |
| 2717 | 2/1909 | United Kingdom | 273/78 |

*Primary Examiner*—Sebastiano Passaniti
*Attorney, Agent, or Firm*—James G. O'Neill

[57] ABSTRACT

A tunable golf club head and a method of adjusting the tuning thereof to improve a golf club head performance for all golfer skill levels, and/or to selectively increase or decrease the maximum distance the club can be used to drive, putt or otherwise propel a golf ball. The tunable head includes an external frame for movably holding and securing a strike plate and separate tuning elements within a golf club head. The separate tuning elements may be comprised of a plurality of tension strings captured in an internal frame, or a plurality of belleville washers, which adjustably coact with the hitting face. The separate tuning elements are adjustable so as to selectively control movement of the strike plate when striking a golf ball, so as to accurately control the velocity and/or direction of a golf ball struck by the strike plate.

30 Claims, 31 Drawing Sheets

TIME 0.399751E-03

TIME 0.799806E-03

TIME 0.119966E-02

TIME 0.399782E-03

TIME 0.119961E-02

TIME 0.159992E-02

TIME 0.199987E-02

TUNABLE GOLF CLUB HEAD AND METHOD OF MAKING

BACKGROUND OF THE INVENTION

1. Field of the Invention

This invention relates generally to golf clubs, and more particularly to a tunable golf club head for a wood, iron or putter, and methods of making and adjusting such tunable heads.

2. Description of Related Art

With the increasing popularity of golf around the world, more and better golf clubs, such as irons, putters and/or woods, are being designed and fabricated. In addition, because of the availability of new and improved materials, such golf clubs are continuously being made so as to be stronger and lighter. However, such stronger and lighter clubs have failed to meet the all of the requirements of players, particularly since the skill levels of players range from those of the beginner, with basically no skills at all, to those of the highly skilled players, such as professionals. Therefore, although some golf clubs may be adequate for a beginner, such clubs might in the hands of a professional, be almost too light and/or provide too much power for the existing conditions of a particular golf course.

Also, because of the continued rise in the number of golfers over the years, and the better and more consistent quality of golf balls which are available, golf club manufacturers have tried to meet the needs of individual golfers by providing golf clubs with heads which are manufactured so as to meet the perceived desires or needs of such golfers.

Typical of the proposed golf club heads which utilize new materials and which attempt to meet some of the perceived desires or needs of various golfers are those shown in U.S. Pat. Nos. 5,064,197 ("'197"), 4,988,104 ("'104"), 4,930,781 ("'781"), 4,928,972 ("'972"), 4,884,812 ("'812"), 4,884,808 ("'808"), 4,618,149 ("'149"), 4,432,549 ("549") and 4,067,572 ("'572"). The '197 patent discloses a method and means to change the sound emitted from a metal "wood" golf club head by providing a pair of chambers within a golf club head behind a resilient face plate, and connecting the pair of chambers together by a throat so that the rear or second of the pair of chambers acts as a Hemholtz resonator the modify the sound propagated in the first or forward chamber upon impact of the resilient face plate with a golf ball. This patent also discusses the use of such a golf club head to maximize the flying distance of the ball, and suggests that if the face plate thereof was made thinner, that not only would the pitch of the club head change, but when striking a golf ball the thinner face plate would have a trampoline-like effect, thereby enhancing the propulsion effects of the club head against the struck ball. However, there is no further disclosure therein as to why such results occur and/or how they may be used to "tune" or change such a club head for an individual user.

The '104 and the '781 patents disclose further golf club head structures, in which the club heads are hollow and include means in the hollow club heads to change the sound emitted by the head, when it strikes a golf ball. The '781 patent also discusses the use of perimeter-weighted woods and irons with a ball striking face or plate having a thin central wall such that the golf striking area produces a result similar to a tennis racquet effect where the ball deflects the forward wall of the thin face plate rearwardly at impact, hugs the ball for about 15 milliseconds and slings it forward off the club face. This '781 patent states that this is sometimes is referred to as the banjo effect, and goes on to discuss what happens when players use such clubs with a thin forward wall, and have an off-center hit, which results in a significant velocity decrease toward the perimeter of the thin forward wall, away from the center, because of a reduction in the "sling shot" effect. However, there is no further disclosure in the '781 patent as to or how such club heads may be modified and/or used to "tune" or change such a golf club head for an individual user.

The '572 patent discloses a golf club having a shaft and a club head in which the club head contains a stationary main body portion and a face portion which is rotatably movable with respect to the stationary portion to vary the angular displacement of the face portion of the club head. However, there is no disclosure in the '572 patent as to or how such club head might be modified and/or used to "tune" or change the reaction of the face portion of such a golf club head, for an individual user.

The '972, '812, '808, '149, and '549 patents disclose various means and methods of providing hollow golf club heads with various fillers and weights, or changeable face plates, to overcome various indicated problems, or to provide specific enumerated advantages.

However, none of these prior art patents meet all of the perceived needs of golfers and these known designs tend to have some or all of the following disadvantages or problems:

(a) The inherent design of the known hollow club heads are substantially permanent after manufacture and cannot be easily or simply changed for a different type of golf club head; or for use in varying conditions; or for a change in skill of a player; or for use with a different golf ball.

(b) Known adjusting means for golf club heads, such as shown in the '572 patent, look unattractive and are limited to specific type club heads for adjusting the angle of the face plate, not the reaction and/or action of the face plate.

(c) No provision is made for "tuning" of a golf club head for use by a weak or unskilled player.

(d) No means is known for modifying golf club heads by asymmetric "tuning" for less talented players with deficient swing mechanics.

(e) No provision is made for "tuning" (actually "detuning") a golf club head for use by a highly skilled or professional player, on a shorter golf course, where substantially below par scoring occurs as a result of today's and tomorrow's high technology golf club heads, and where the golf course layout cannot be changed, so as to maintain the golf course's posted scoring level.

Finally, even if some of the known club heads could be modified to overcome some the above set forth problems, others are caused, or may still remain. Therefore, there is a long standing need in the art for a method to accomplish and a golf club head that may be individually adjusted or "tuned" for use by different players as, for example, to replace expensive lessons for swing correction, or for use on different golf courses, and/or for use with different golf balls. The device and method of the present invention overcomes many of the known limitations and problems, and may be adapted for use with any type of club head, to provide golf club heads that may be adjusted so as to react in a predetermined manner when used by a specific golfer to strike a golf ball of known resiliency. The novel golf club head assembly of the present invention is comparatively easy to manufacture and "tune" for specific applications and players.

SUMMARY OF THE INVENTION

Accordingly, it is a general object of the present invention to provide an improved wood, iron or putter.

It is a particular object of the present invention to provide an improved golf club head for a wood, iron or putter which may be securely attached to a shaft.

It is a still more particular object of the present invention to provide a hollow golf club head assembly for a wood which is selectively tunable.

It is yet a more particular object of the present invention to provide a golf club head assembly for a wood, iron or putter having a hitting plate that cooperates with adjustable tuning means.

It is a further particular object of the present invention to provide a golf club head assembly for a wood, iron or putter having a hitting plate that cooperates with adjustable tension strings.

It is a yet another particular object of the present invention to provide a golf club head assembly for a wood, iron or putter having a hitting plate that cooperates with belleville washer-type tuning means in preselected areas.

It is a still further particular object of the present invention to provide a golf club head assembly for a wood, iron or putter having a resilient hitting plate that is guided in movement in a securing frame and that cooperates with adjustable tuning means.

And, it is also a particular object of the present invention to provide a new method for tuning a golf club head for predetermined characteristics, when manufactured, and for modifying these characteristics thereafter.

In accordance with one aspect of the present invention, there is provided a golf club head having a body and a hitting plate secured together with a recessed opening therebetween so as to be in contact with a plurality of separate tuning elements secured within the recessed opening, which plurality of separate tuning elements are separately adjusted so as to selectively control the movement of the hitting plate when it strikes a golf ball, to thereby selectively control the movement of the struck golf ball.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to describe improved tunable golf club heads and a method for tuning the same.

It is to be understood that the present invention is an improvement in and an elegant solution to the provision of golf club heads that may be used to control the velocity and direction of a golf ball struck thereby, and that it may easily be mounted to any desired shank, in a manner known to those skilled in the art, to make a golf club head that may be tuned to a specific individual, or for a specific reason, or to correct a specific problem, or for a combination of any or all of these reasons. The golf club head may be made from any currently available, or to be discovered material, so as to make a specific golf club, and is specifically described herein, for purposes of description only and not by way of limitation, for use as a golf club head in a wood, iron, or a putter, although it is to be understood that the invention may also be applied to any other type of golf club imaginable.

Figure 1:
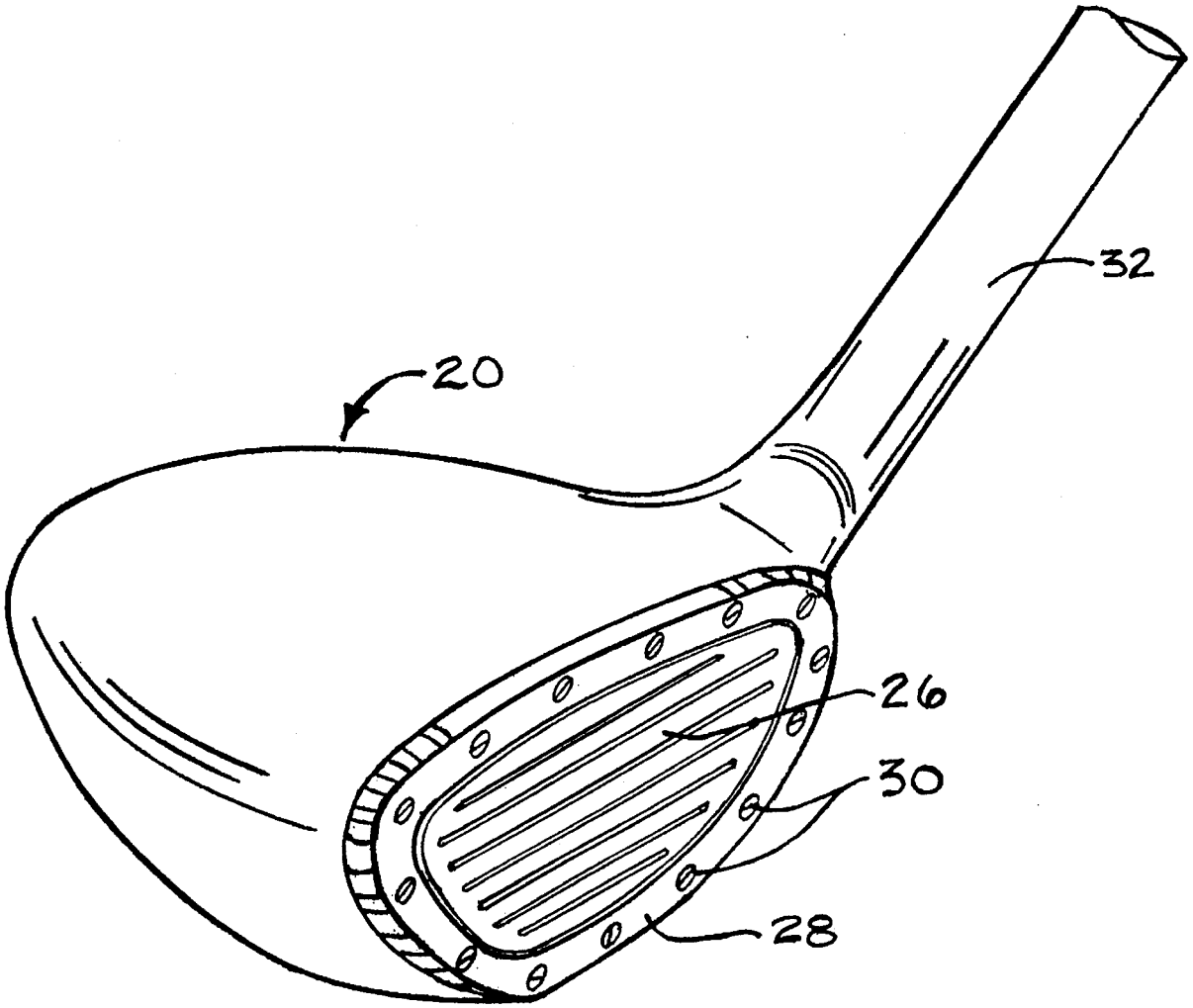
FIG. 1 is a perspective view of a golf club head of the present invention, in the form of a wood.
Figures 2, 2A, 2B:
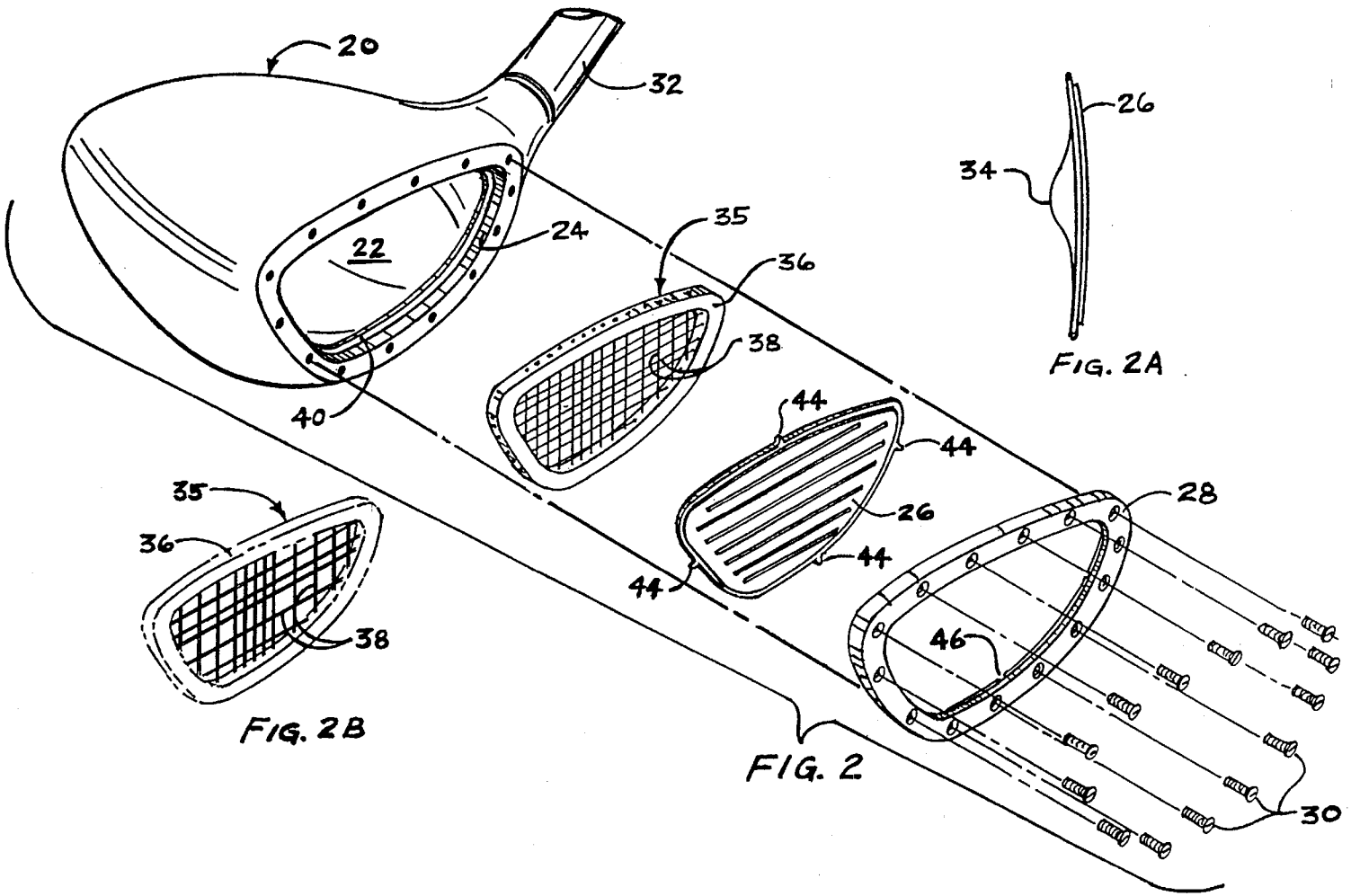
FIG. 2 is an exploded perspective view of one embodiment of the wood golf club head of FIG. 1, having a tension string tuning means.
FIG. 2A is a top plan view of the striking plate of FIG. 2.
FIG. 2B is a perspective view of a further embodiment of the tennis racquet-like tension string tuning means.
Figure 3:
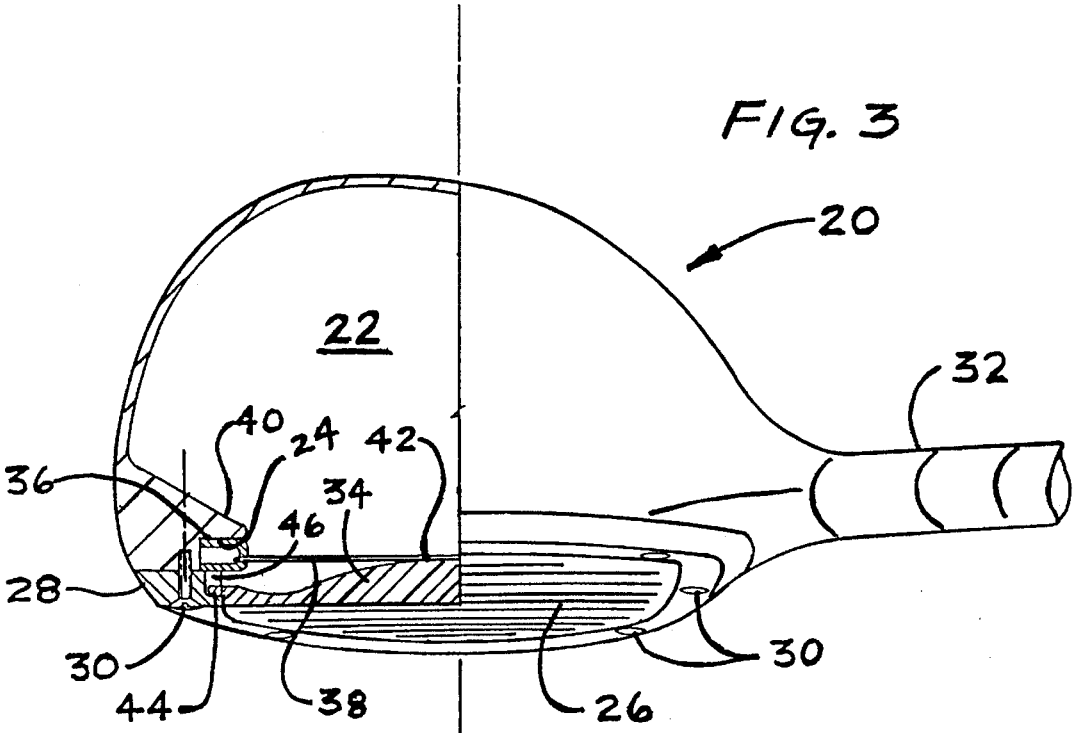
FIG. 3 is top plan view, partially in cross-section, of the club head of FIG. 1.

Turning now to FIGS. 1–4 of the drawings, a preferred embodiment of a golf club head, in the form of a wood, is generally identified as 20. As is best shown in FIGS. 2 and 3, this head is substantially hollow, having a rear surface and a front surface, with a single internal cavity or chamber 22, and a single, shaped, recessed opening 24 in the front surface. A hitting or striking plate 26, preferably formed from metal, but which could also be formed of any available composite material, is secured in or around the recessed opening 24 in the front surface, by a frame means 28, preferably made from metal, or a composite material, and securing means, such as a plurality of screws 30. A hosel 32 projects upwardly from the top wall of the head 20 in a conventional fashion. The thickness, shape and resiliency of the strike plate may be varied, depending on the use of the club and in accordance with the specific adjustment or strength of the "tuning means", described more fully below.

As discussed above, it is known in the prior art that when a thin walled club face hitting or striking surface of a golf club head strikes a golf ball, the thin wall will be moved or will bend so as to have a trampoline-like effect on the struck ball; or that the thin wall will first deflect rearwardly at impact, hug the ball for a short period of time, and then sling the ball forward off the thin wall hitting surface. The present invention, however goes several steps beyond this known deflection of a golf club thin wall hitting surface, by providing means within the head to coact with and control the movement of a separate and distinct strike plate 26, so as to selectively tune the club and to enhance its performance or, to detune the club so as to enable a professional or other seasoned golfer to post scoring rounds at or near the course rated par scoring levels on shorter courses, and/or to correct any deficiencies induced by the swing of a golfer using the same.

Figure 4:
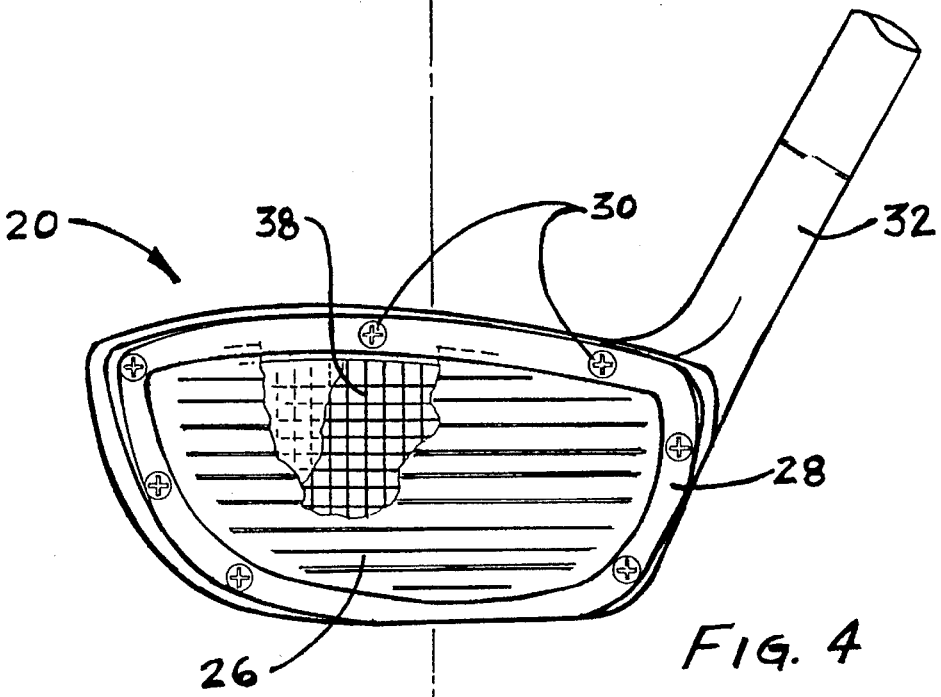
FIG. 4 is front elevational view, partially in cross-section, of the club head of FIG. 1.

As best shown in FIGS. 2–4, the strike plate 26 of the present invention is provided with a front face of any desired configuration of a type known to those skilled in the art for hitting a golf ball. Additionally, the strike plate 26 may be of any desired thickness around its edges, but is provided with a bulbous or extending portion 34 formed to or secured to a rear face thereof. A tuning means 35, such as that shown in FIG. 2, in the form of a tennis racquet-like head, having a frame 36, with a plurality of tension strings 38 adjustably mounted therein, is secured behind the recessed opening 24, between an annular lip 40 formed integrally with or to the internal chamber 22, and the rear face of the strike plate 26. The frame 36 of the tuning means 35 is preferably made from metal, or a composite material, and U-shaped in cross-section, as shown in FIG. 3. The tension strings 38 may be fabricated from high strength materials, selected from the group of carbon, fiberglass, stainless steel, etc., and are adjustably and removably mounted in the frame, in a manner best known to those skilled in the art of tennis racquet stringing. The tension strings 38 secured within the frame 36 may be of any desired material or size, and as best shown in FIG. 2B, may be replaced by a further frame in which the tension strings may be still different, and/or have different spacing therebetween. Thus, the replaceable and/or adjustable tuning means 35 provides the desired effect of controlling or tuning the movement of strike plate 26, as described more fully hereinafter.

With the strike plate 26 of the present invention secured in the club, as shown in FIGS. 1, 3 and 4, the bulbous portion 34 of the rear face of the plate 26 will be in contact with the tension strings 38 of the tuning means 35, preferably at the central area thereof, as at area 42 shown in FIG. 3. With this arrangement, when the strike plate 26 hits a golf ball, because of the contact or coaction of the bulbous portion 34 with the tension strings 38 at area 42, the deflection of the strike plate may be selectively controlled. This deflection control or "tuning" may be calculated, as set forth in more detail below, by taking into account the materials used, their thickness, the tension in the strings 38, the resiliency of the golf ball being struck, and other variables.

As is best shown in FIG. 2, the strike plate 26 is also provided with a plurality of integral guide means or fingers 44 formed thereto, cooperating within a like number of keyways or slots 46 formed in the frame 28. Therefore, with the strike plate 26 secured to the club head in the recessed opening 24 by the frame 28, the guide means 44 will also be in the keyways 46, and the strike plate 26 will, after striking a golf ball, depending on the adjustment of the tuning means 35, be slidably guided in the keyways, if the strike plate 26 moves away from the front of the frame 28.

Figures 5, 6:
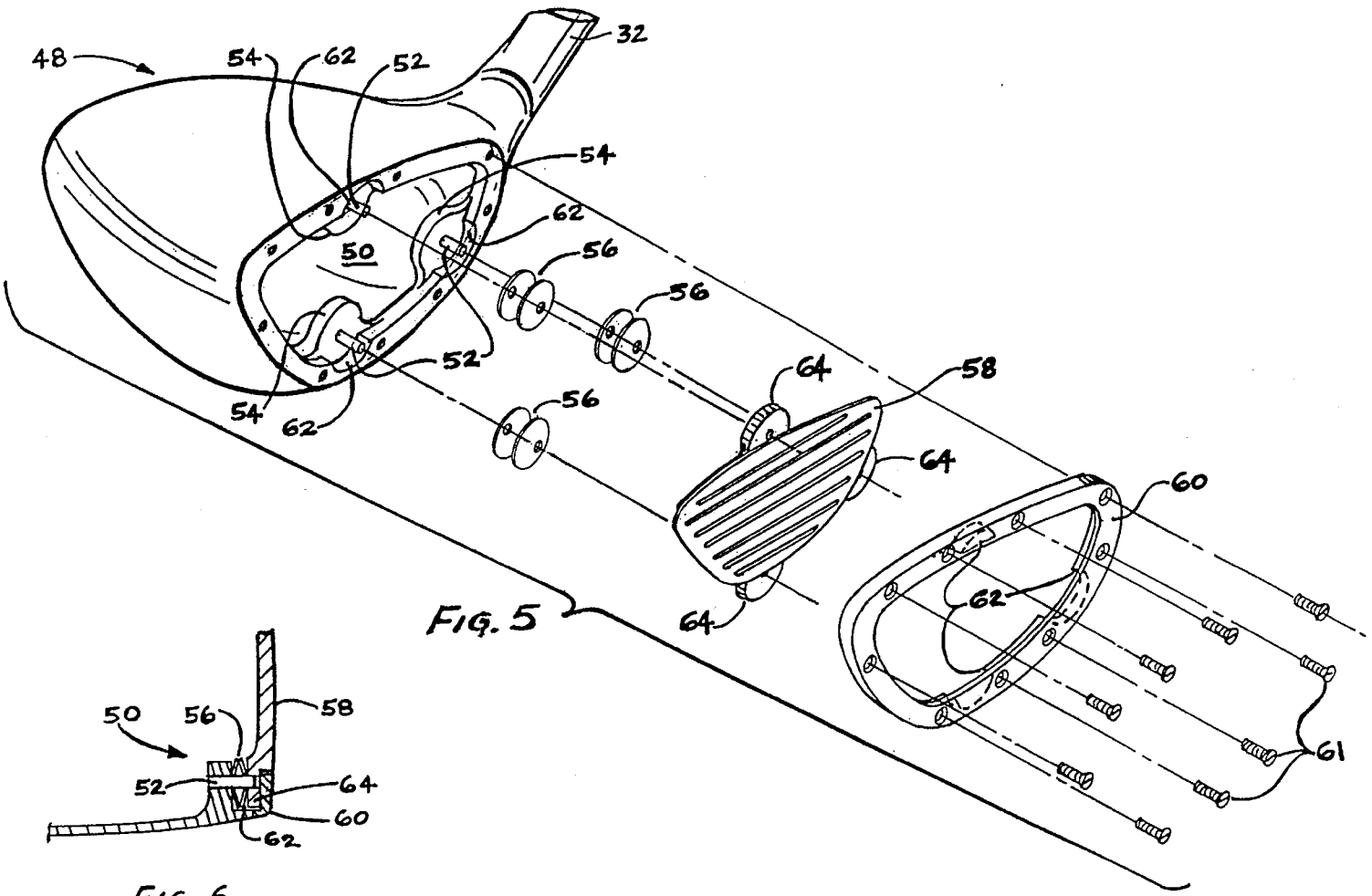
FIG. 5 is an exploded perspective view of a second embodiment of the club head of FIG. 1, having belleville washer-type tuning means.
FIG. 6 is an enlarged, partial sectional view of one of the belleville washer-type tuning means secured in the housing of the club head of FIG. 5, with the hitting plate and securing frame in position.

Referring now to FIGS. 5 and 6, there shown is a further embodiment of a tunable wood golf club head of the present invention. A hollow head 48, substantially similar to head 20, except that instead of an annular lip 40 formed within the recessed opening 24 into an internal cavity or chamber 50, there is provided a plurality of pin means 52, formed to or integrally with, localized lips 54, which in turn are secured in or formed integrally with the wall of the internal chamber 50 adjacent the recessed opening 24. A plurality of tuning means, such as pairs of belleville washers or similar biasing means 56, are slidably mounted on pins 52, and secured in place by a hitting or striking plate 58, also slidably mounted over the pins, and secured to the club head 48 by a separate frame means 60, and a plurality of securing means, such as screws 61. The frame 60 and the recessed opening of the club head are provided with a plurality of arcuate openings 62, into which a plurality of lugs 64, secured to the face plate 58, are slidably held. When the elements of the club head are assembled, the lugs 64 are normally biased toward the front of face plate 58 by the biasing action of the tuning means 56.

With the strike plate 58 secured in the club head 48, as shown in FIG. 6, the lugs 64 of the strike plate will be in contact with the tuning means 56 so that when the strike plate 58 hits a golf ball, and the strike plate 58 deflects rearwardly at impact, this deflection of the face plate may be selectively controlled, by varying the biasing action or strength of the tuning means 56, as well as the strength and thickness of the material used in the strike plate.

Figure 7:
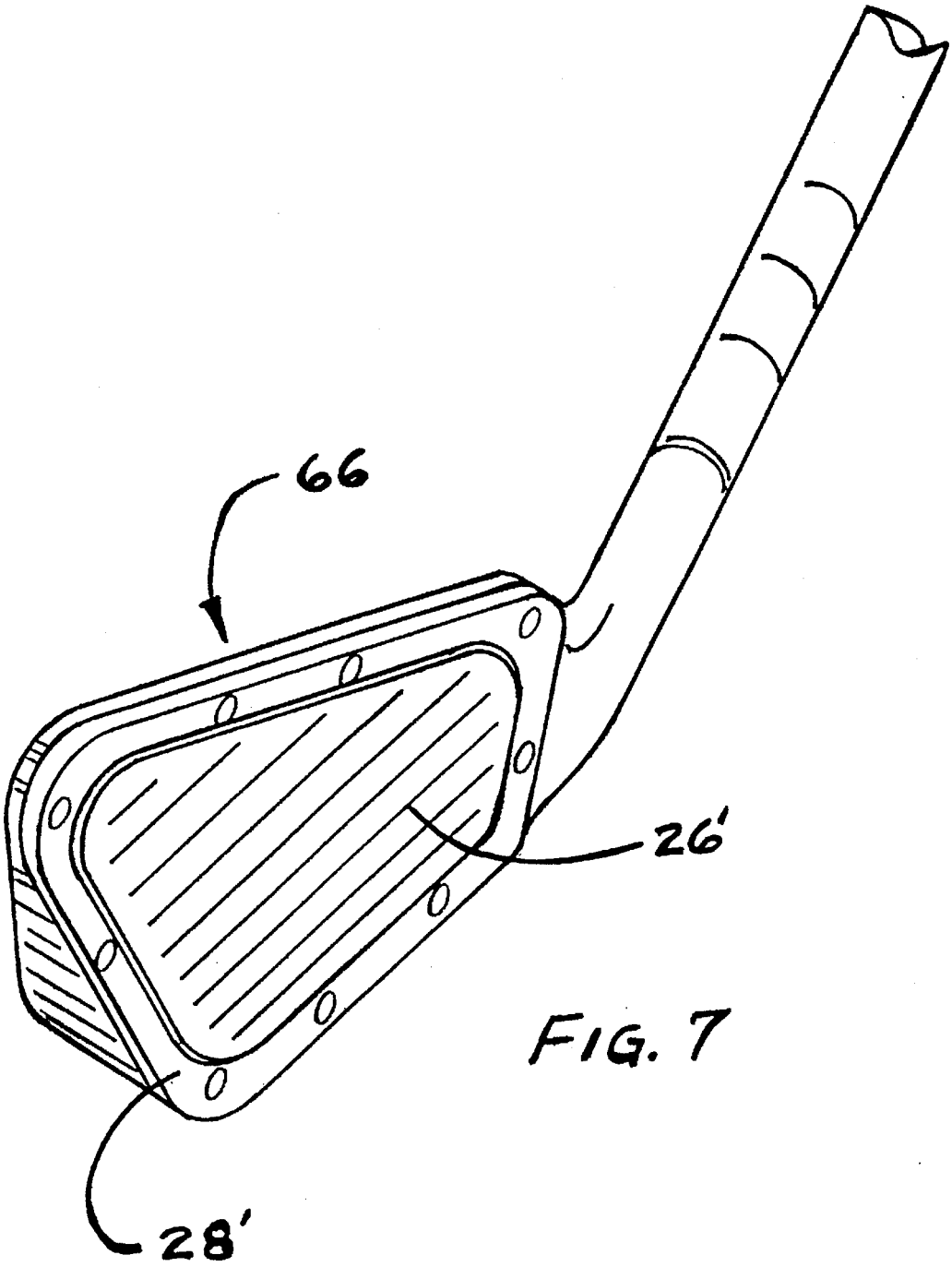
FIG. 7 is a perspective view of a further golf club head of the present invention, in the form of an iron.
Figure 8:
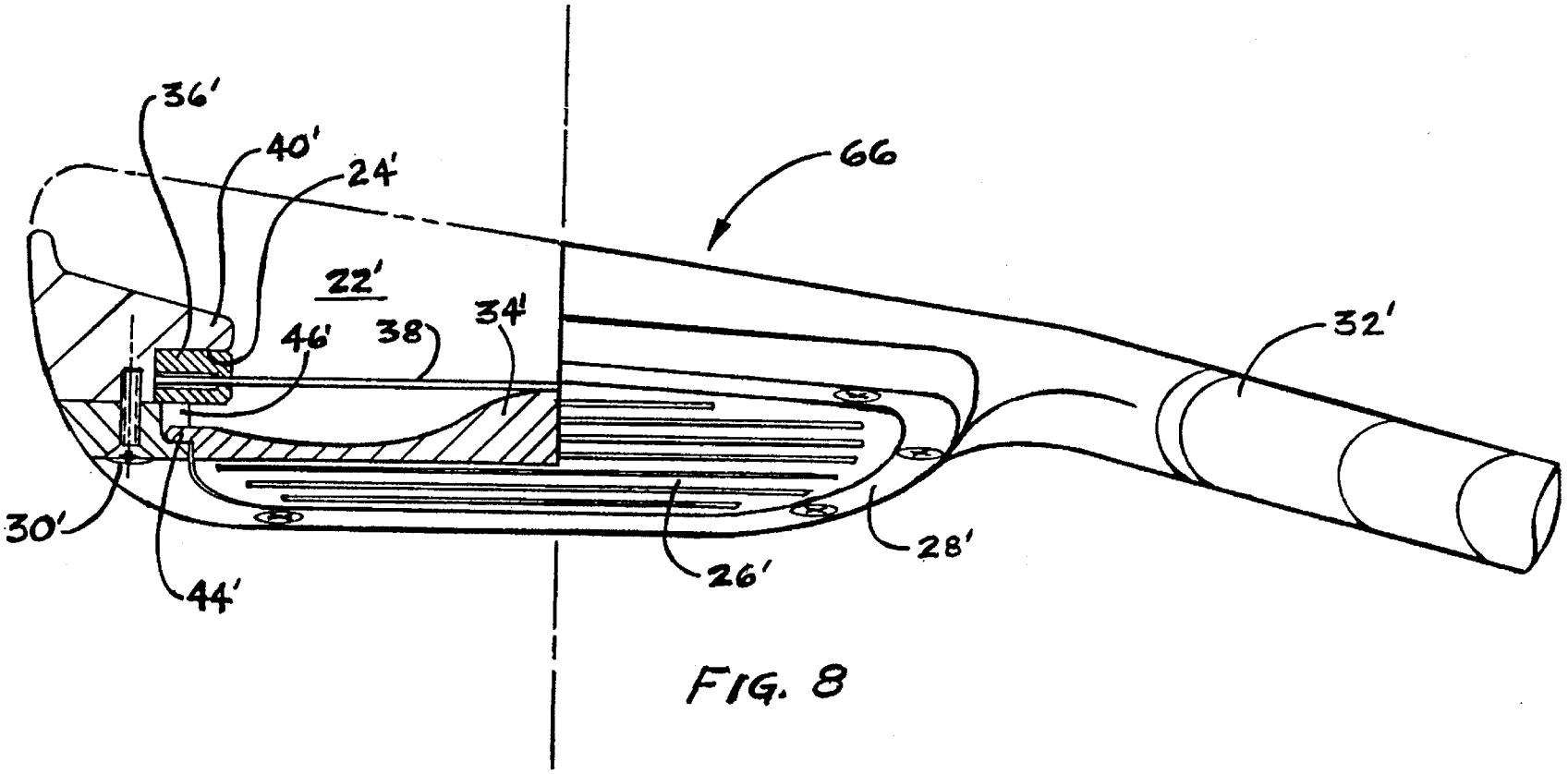
FIG. 8 is an enlarged top plan view of one embodiment of the club head of FIG. 7, having a tension string tuning means.
Figure 9:
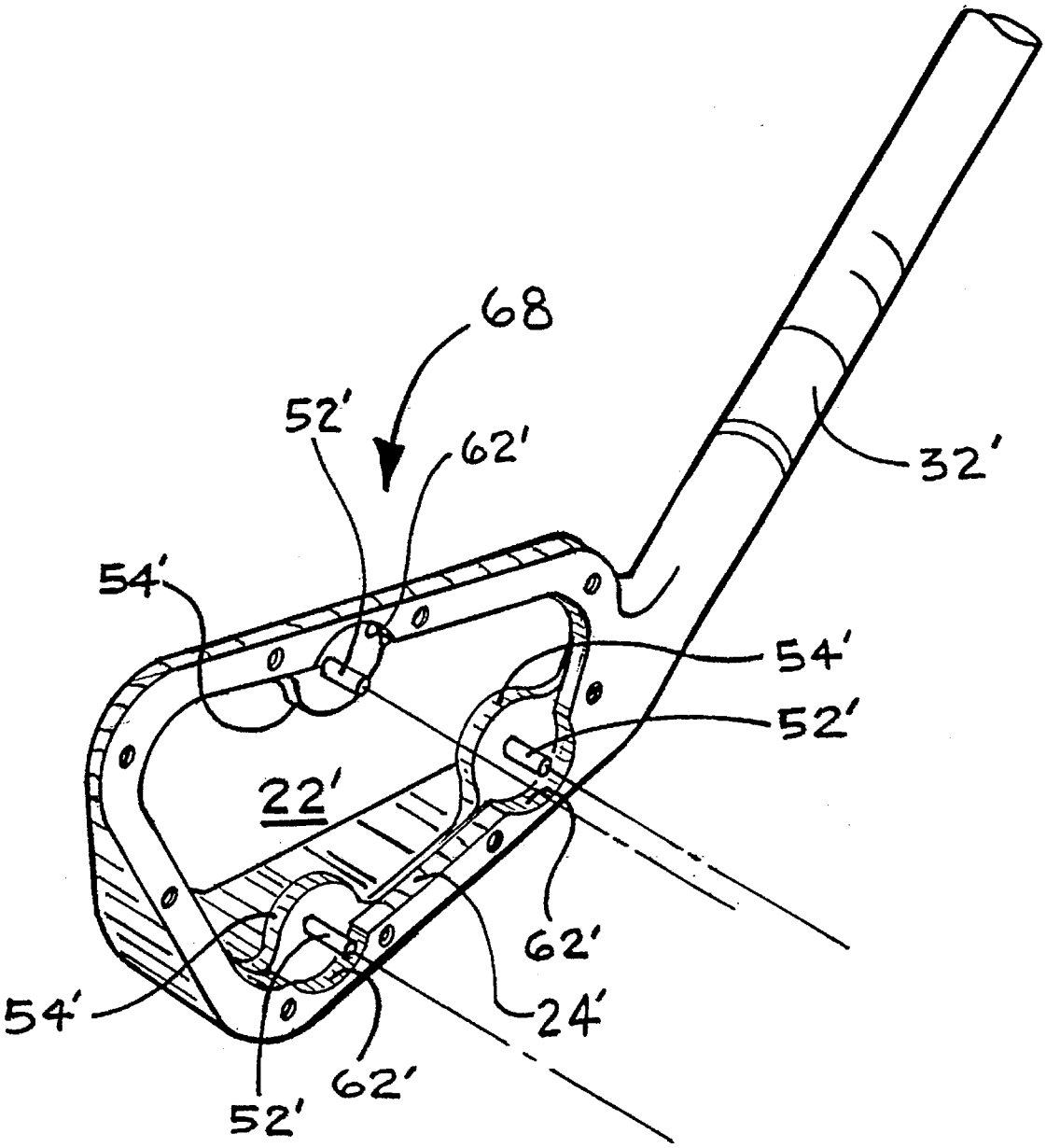
FIG. 9 is partial perspective view of a second embodiment of the club head of FIG. 7, having pin means therein for mounting belleville washer-type tuning means.

Turning now to FIGS. 7–9, there shown are further embodiments of the inventive club head, as adapted to be used on an iron. Particularly, as shown in FIGS. 7 and 8, a head 66 is provided with a recessed opening 24' which is connected to a further opening or passage 22' passing entirely through the club head A hitting or strike plate 26', substantially similar to the face plate 26 of head 20 is secured in the recessed opening 24' at the front of the club head. The strike plate 26' is held in place by a frame means 28' and securing means, such as screws 30', and includes a rear face having a bulbous portion 34'. A tuning means in the form of a tennis racquet-like head, having a frame 36' with a plurality of tension strings 38' adjustably mounted therein, is secured within the recessed opening 24' between an annular lip 40' formed integrally with or to the extended portion of the opening 22', and the strike plate 26'. The frame 36' of the tuning means is preferably U-shaped in cross-section, as shown in FIG. 8, with the tension strings 38' adjustably mounted in the frame 36'. The tuning means may be replaced, and/or the tension strings 38' may be of any desired size, and spacing, and may be made from any desired material to provide the desired effect of controlling or tuning the movement of face plate 26', in the same manner as described above, in connection with the embodiment of FIGS. 1–4. That is, to change the reaction of the club head, or "tune" it, the strike plate 26' is removed and the tension strings changed by lightening them, loosening or tightening them, or by changing the strings, and/or the string pattern, and/or the entire tuning means, until the desired results calculated to be produced for a player, by the method of the present invention are achieved.

As is best shown in FIG. 8, the strike plate 26', is also provided with a plurality of integral guide means or fingers 44', cooperating within a like number of keyways or slots 46' formed in the frame 28', so that the strike plate 26' will be guided in the keyways, if it moves a predetermined distance away from the front of the frame 28', as described above In FIG. 9 there is shown a further embodiment of the tunable iron golf club head of the present invention. A club head 68, substantially similar to head 66, except that instead of an annular lip 40' formed within the recessed opening 24', there is provided a plurality of pin means 52', formed to or integrally with raised localized lips 54', which in turn are secured in or formed integrally with the recessed opening 24'. A plurality of tuning means, such as the pairs of belleville washers 56, shown in FIG. 5, are slidably mounted on pins 52', and secured in place by a strike plate, such as a strike plate (not shown) similar to strike plate 58 of FIG. 5, also slidably mounted over the pins and secured to the club head by a separate frame means, such as a frame (not shown) similar to frame 60 of FIG. 5, and a plurality of securing means. The frame holding the strike plate and the recessed opening 24', are also provided with a plurality of arcuate openings 62', into which a plurality of lugs (not shown), such as those shown at 64, secured to the strike plate 58, would be slidably held. The club head 68 would, therefore, have a strike plate which would act in the manner of strike plate 58 described above, in connection with FIG. 5.

Figure 12:
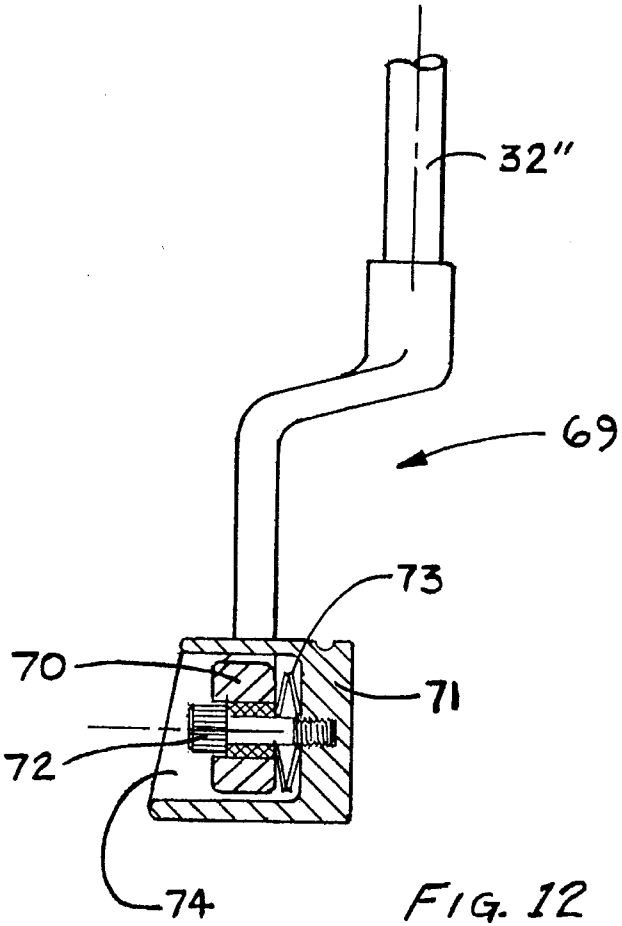
FIG. 12 is a sectional view of the putter golf club head of FIG. 10, through one of the belleville washer-type tuning means held on an adjustable cap screw, between a support plate and a strike plate housing of the club head.
Figure 10:
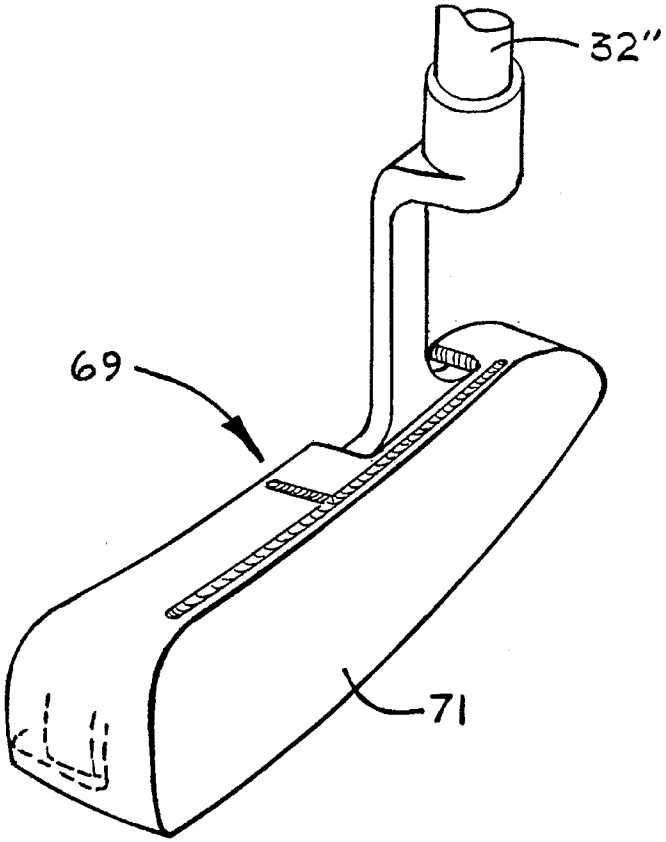
FIG. 10 is a perspective view of a further golf club head of the present invention, in the form of a putter.
Figure 11:
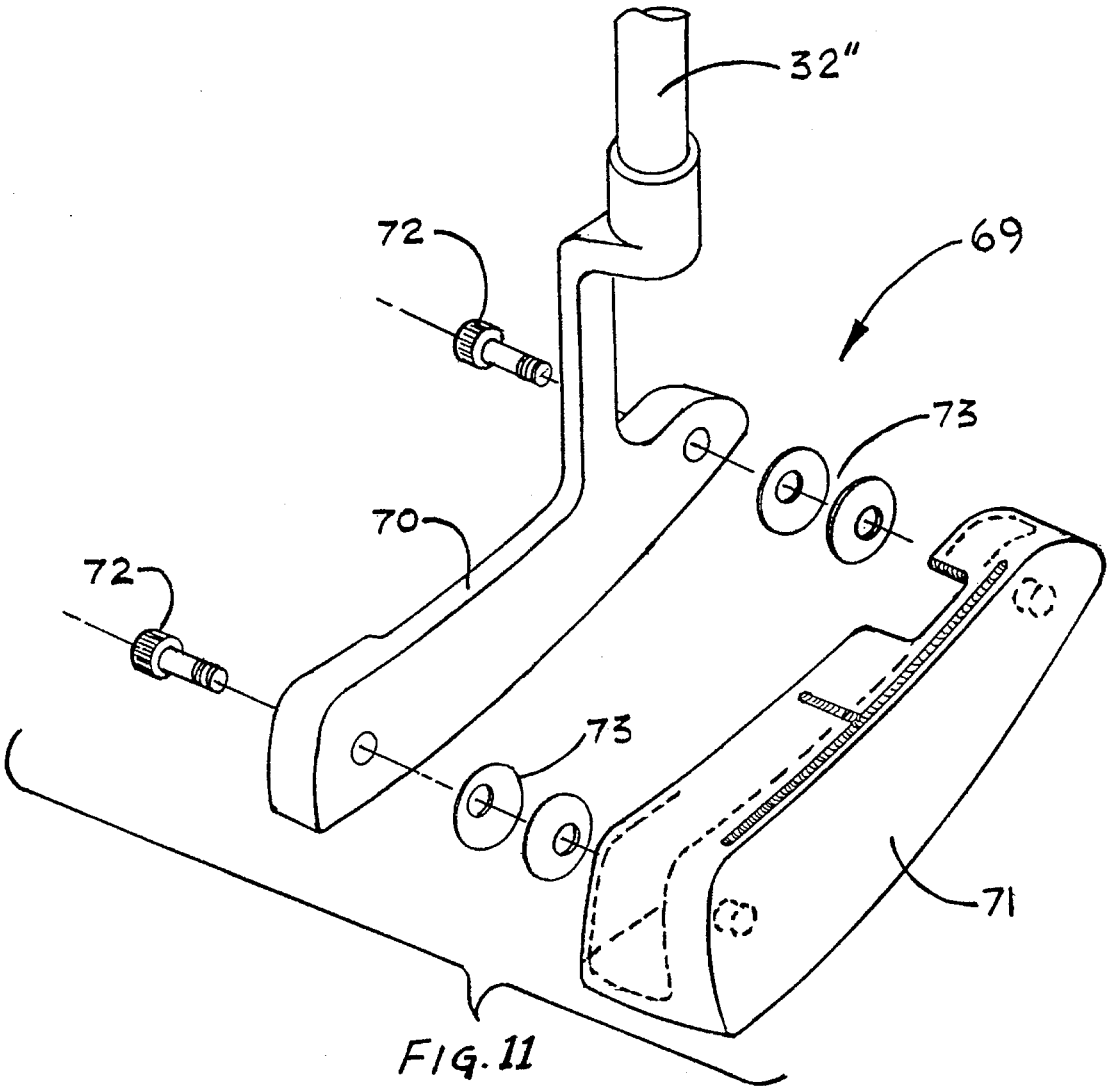
FIG. 11 is an exploded perspective view of one embodiment of the putter club head of FIG. 10, having belleville washer-type tuning means.

FIGS. 10–12 show a still further embodiment of the inventive club head, as adapted to be used on a putter, having a club head, generally identified as 69. As is best shown in FIGS. 11 and 12, the club head 69 is composed of a separate body or support plate 70 integrally attached to a hosel 32". A hitting or strike plate means 71, which may take any desired form, including that of a substantially flat strike plate having front and rear faces, with a recessed opening 74 formed integrally with or secured to the rear face of the strike plate, so as to form a strike plate housing capable of adjustably holding the support plate 70 therein. The strike plate means 71 is secured to the support plate 70 by securing means, such as a plurality of adjustable cap screws 72 which pass through openings formed in the support plate 70 and are removably captured in threaded openings formed in the rear face of strike plate means 71, as is best shown in FIG. 12. A plurality of tuning means, such as pairs of belleville washers 73, similar to the washers 56, are slidably mounted on the shanks of the adjustable cap screws 72, and secured within the recessed opening in the strike plate housing, by the entrapment between the cap screw fastened support plate 70 and the rear face of the strike plate.

Therefore, with the strike plate means 71 secured to the support plate 70, as shown in FIGS. 10 and 12, the front surface of the support plate 70 and the rear face of the strike plate means 71 will be in contact with the tuning means 73 so that when the strike plate means 71 hits a golf ball, and the strike plate means 71 deflects rearwardly at impact, this deflection of the strike plate means may be selectively controlled, by varying the biasing action or strength of the tuning means 73, as well as the strength and thickness of the material used in the strike plate means 71.

Figure 13:
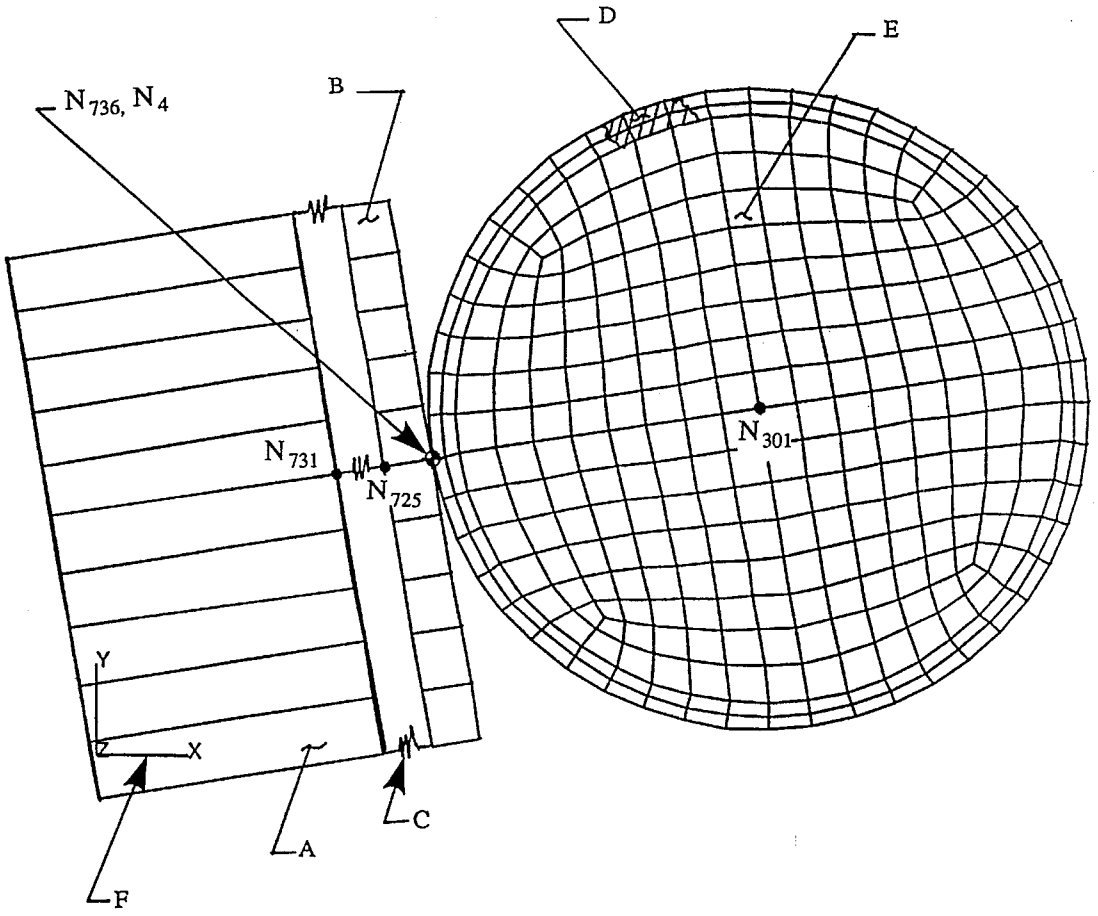
FIG. 13 is a schematic representational view of an analytical simulation finite element model (FEM) of golf club head of the present invention striking another analytical simulation FEM of golf ball, to aid in explanation and validation of the method for tuning such golf club heads.

Turning now to FIGS. 13–34, the method of calculating or determining how a specific golf club head is tuned is now explained. That is, how to calculate the most accurate or correct club head for use by a player having known qualities, may be determined for a particular golf club swing motion, golf ball, and/or for a particular golf course. Turning first to FIG. 13, there shown is a three dimensional analytical simulation finite element model (FEM) of the club head, strike plate, tuning means or springs, and golf ball used to demonstrate how the tunability and what actually occurs when using the present invention. See following summary and definitions:

FINITE ELEMENT MODEL (FEM) SUMMARY

An explicit three-dimensional (3D) finite element code was used to analyze the nonlinear large deformation dynamic response of the elastic and inelastic solids undergoing impact. The contact-impact algorithm permited gaps and sliding impact surfaces along and between discontinuous material interfaces with friction (i.e., ball-strike plate and ball cover).

A — Constant Mass Metal Club Head

B — Constant Mass Metal Ball-Strike Hate

C — Tunable Linear Springs Simulating Ball-Strike Plate Support (Varied For "Analytical Simulation" Testing)

D — SURLYN® Ionomer Resin Ball Cover

E — Rubber Ball Core

F — Global Finite Element Analysis (FEA) Coordinate Frame $N_{731}$ — Node Number 731 In FEA Model $N_{725}$ — Node Number 725 In PEA Model $N_{736}$ — Node Number 736 (Located On Ball-Strike Plate Surface) In PEA Model $N_4$ — Node Number 4 (Located On Ball Surface) In PEA Model $N_{301}$ — Node Number 301 In PEA Model Notes:

1. $N_{736}$ and $N_4$ Have Identical Coordinate Positions At Initial Ball Impact.

2. Analytical Simulation Initial Conditions Summary

A — Constant (With Respect To Time) X—Axis Velocity ($V_x$)=1760 in/sec.

B,C — Initial X — Axis Velocity ($V_{Ox}$)=1760 in/sec.

D,E — Initially At Rest ($V_{Ox}$)=0.0 in/sec.

Figure 14:
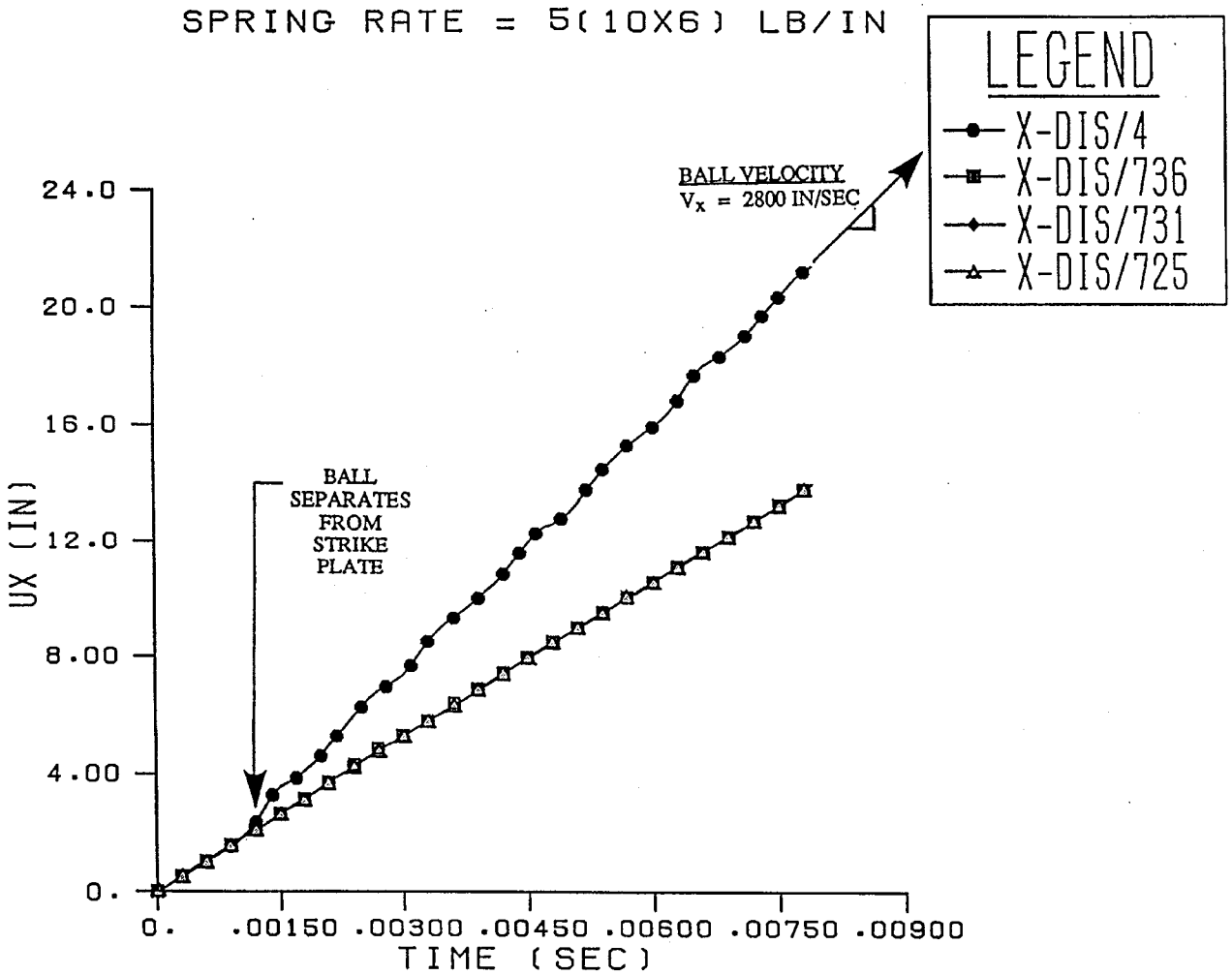
FIGS. 14–33 are a series of schematic representational views showing time history plots of deflection and/or velocity versus time, for analytical node locations noted in FIG. 13, and for deformed versus undeformed FEM shape plots of golf club head and golf ball at different time intervals.
Figure 15:
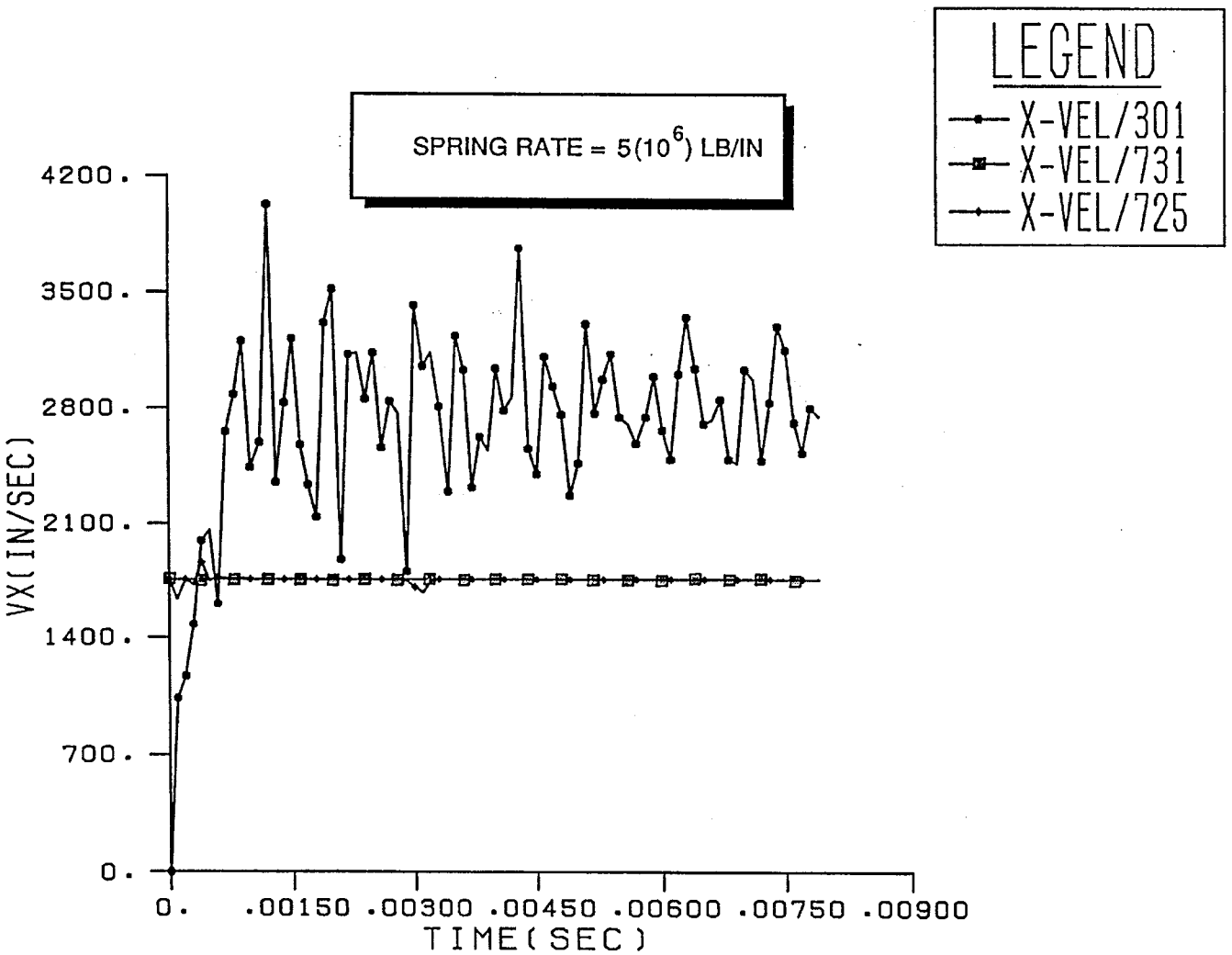
Figure 16:
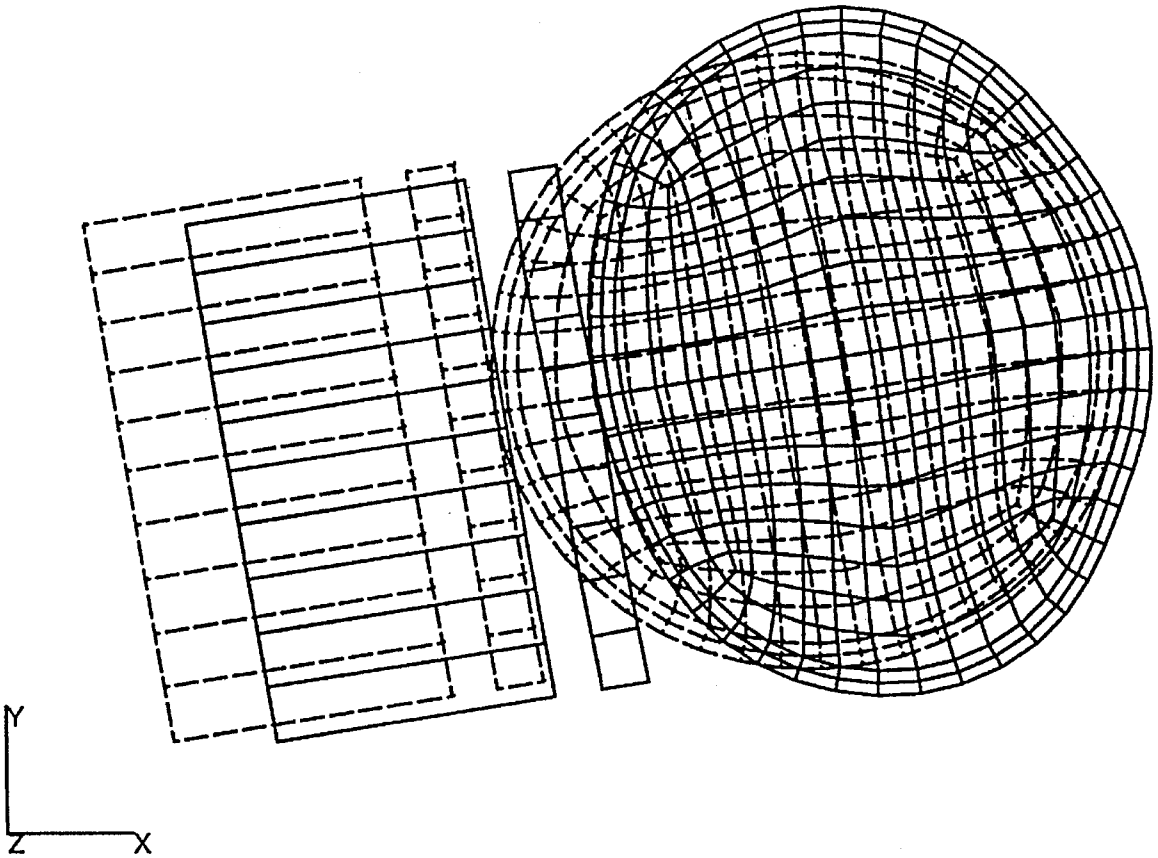
Figure 17:
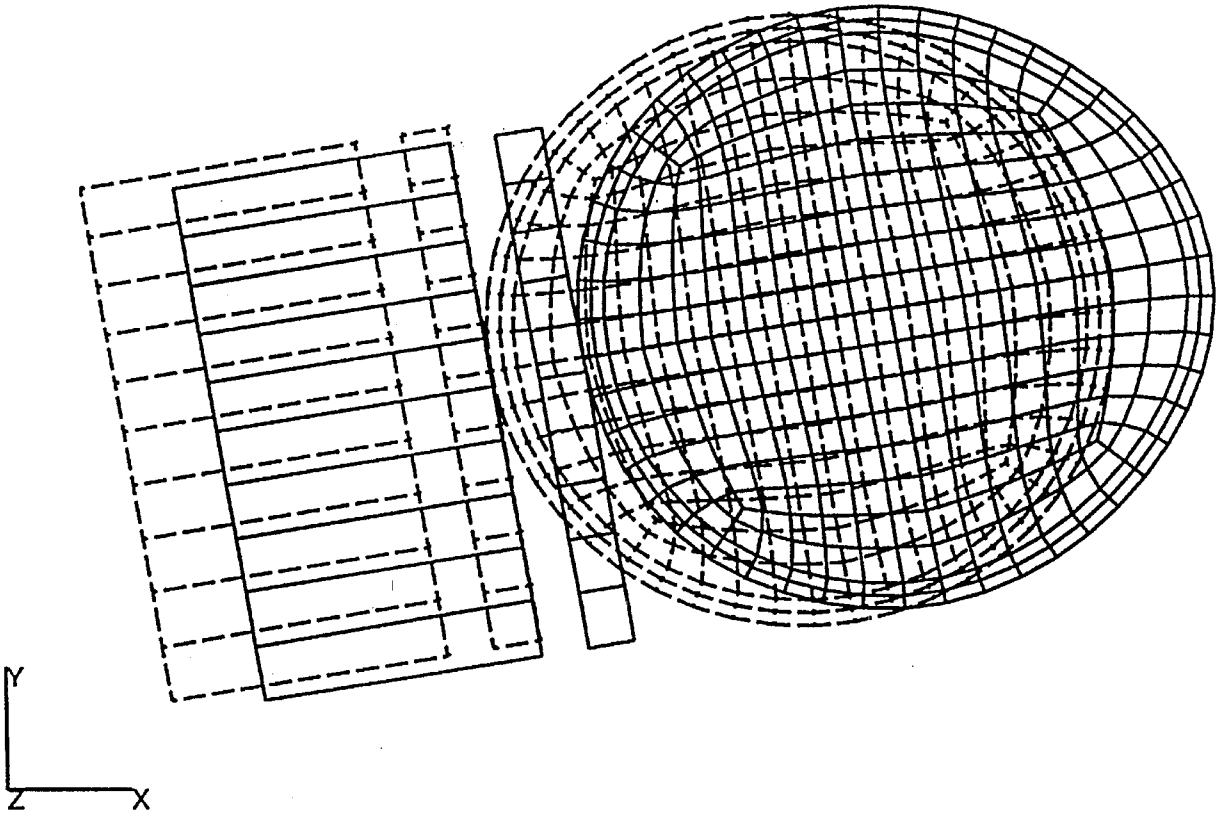
Figure 18:
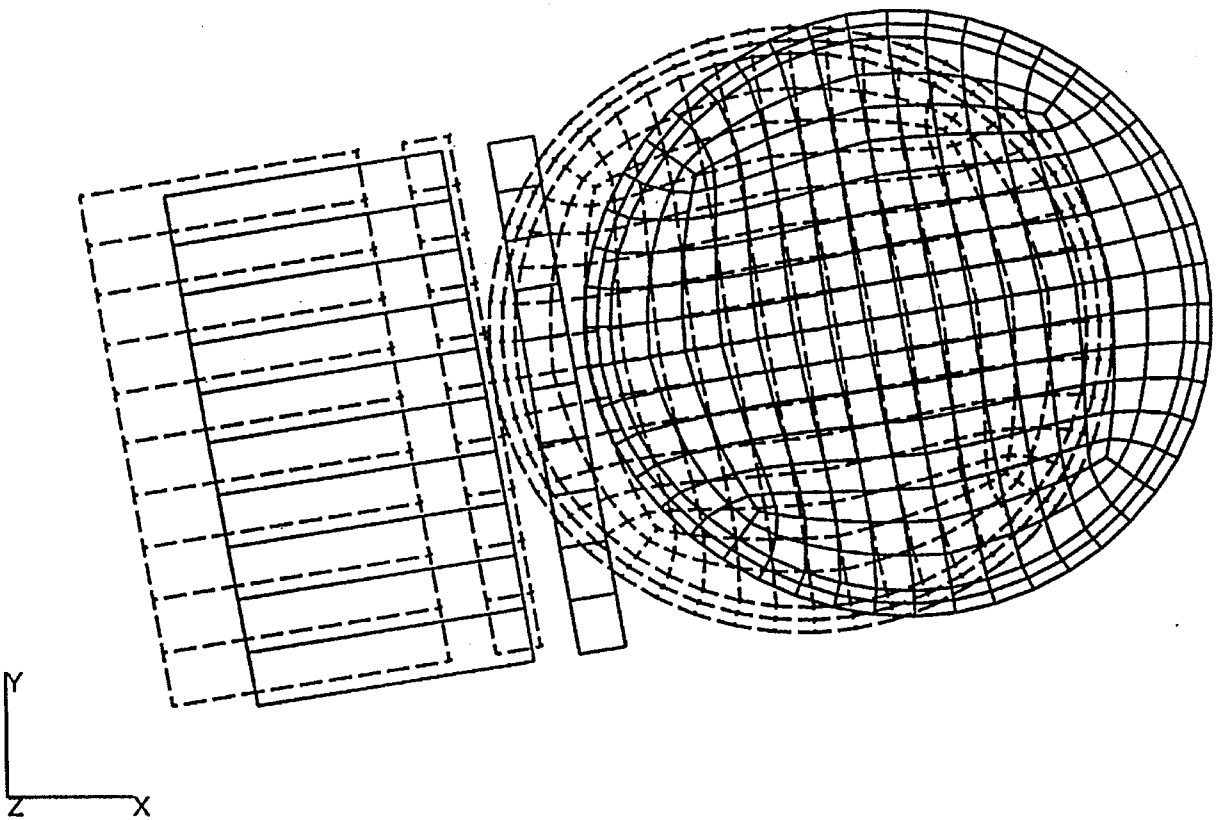
Figure 19:
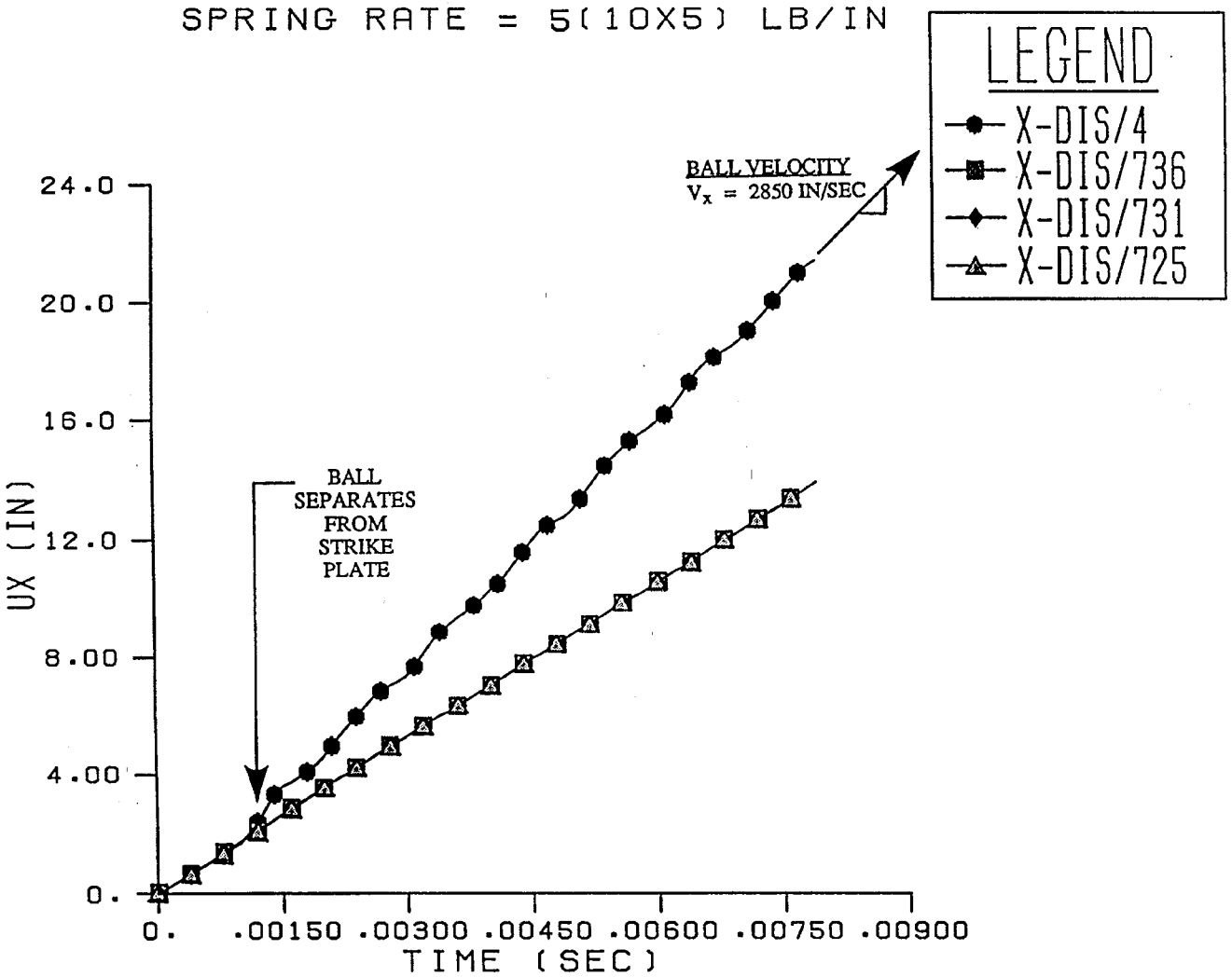
Figure 20:
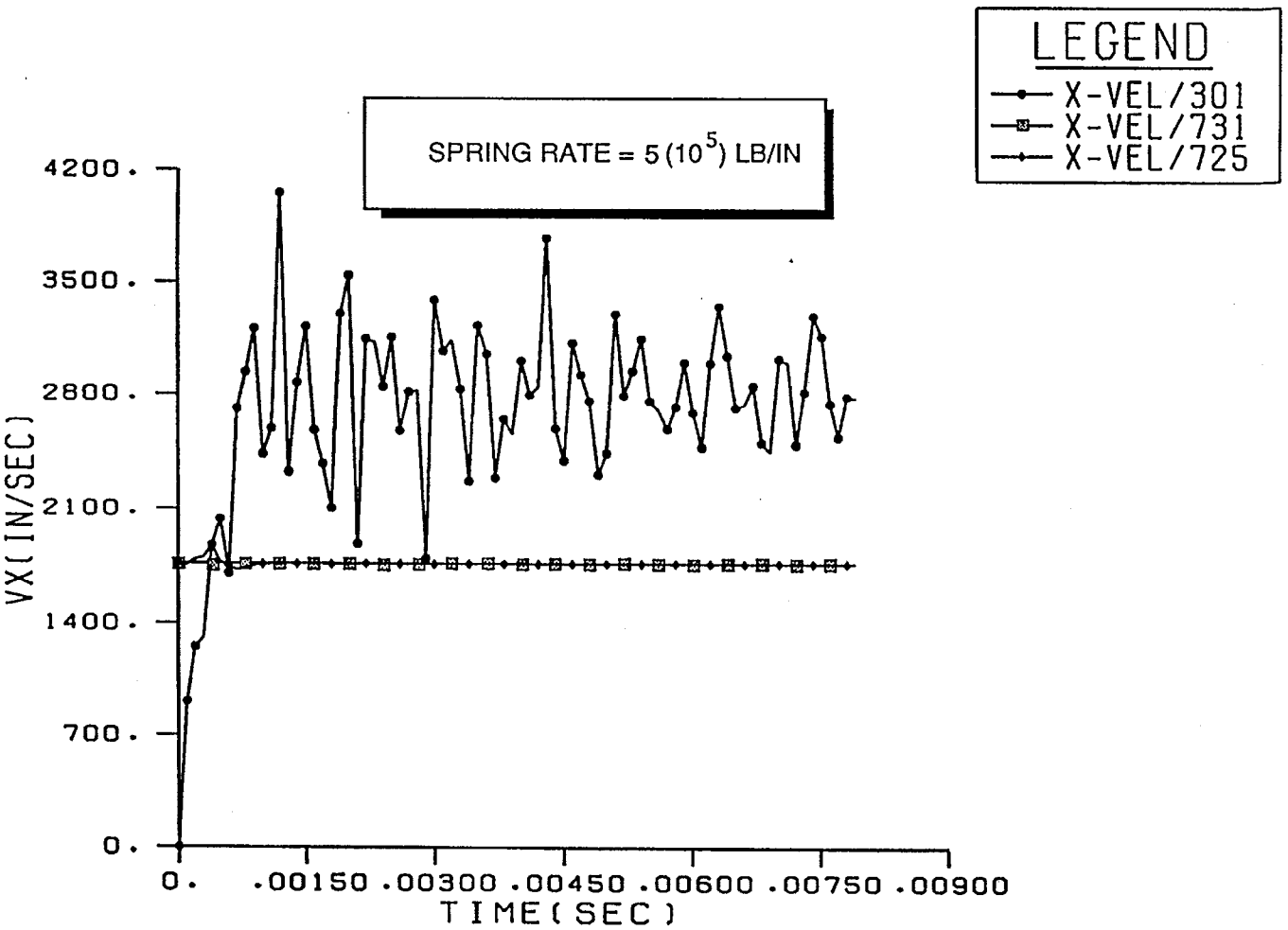
Figure 21:
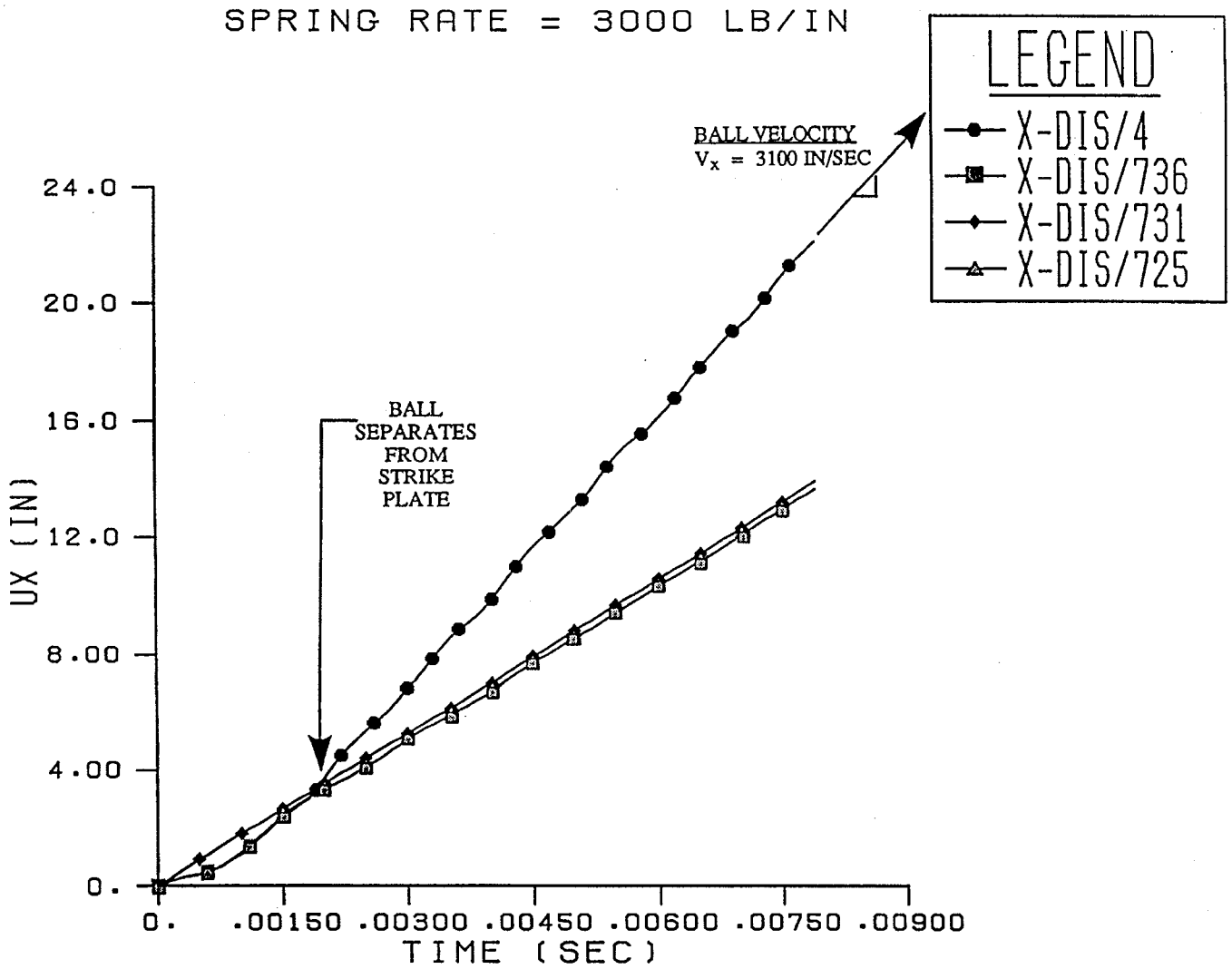
Figure 22:
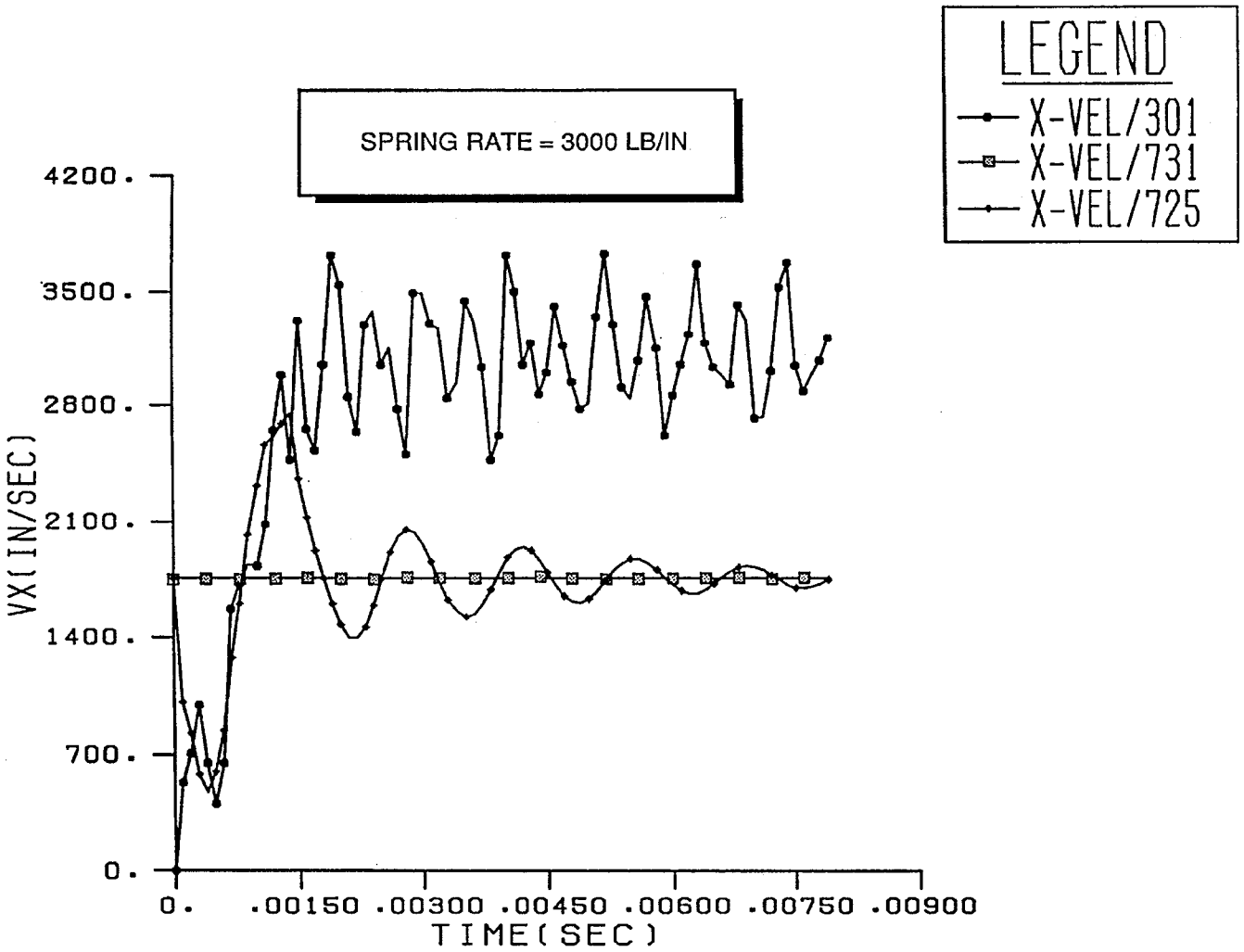
Figure 23:
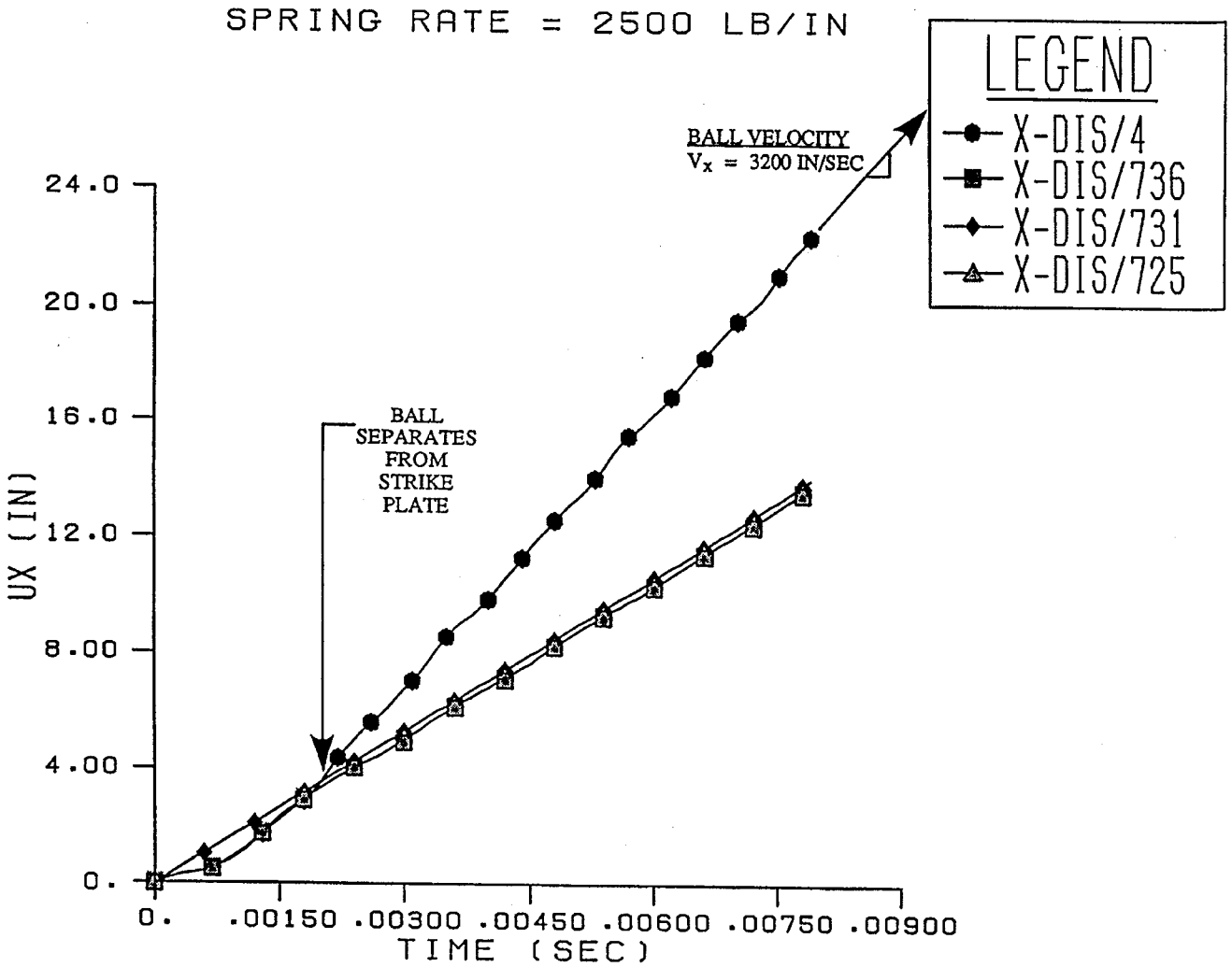
Figure 24:
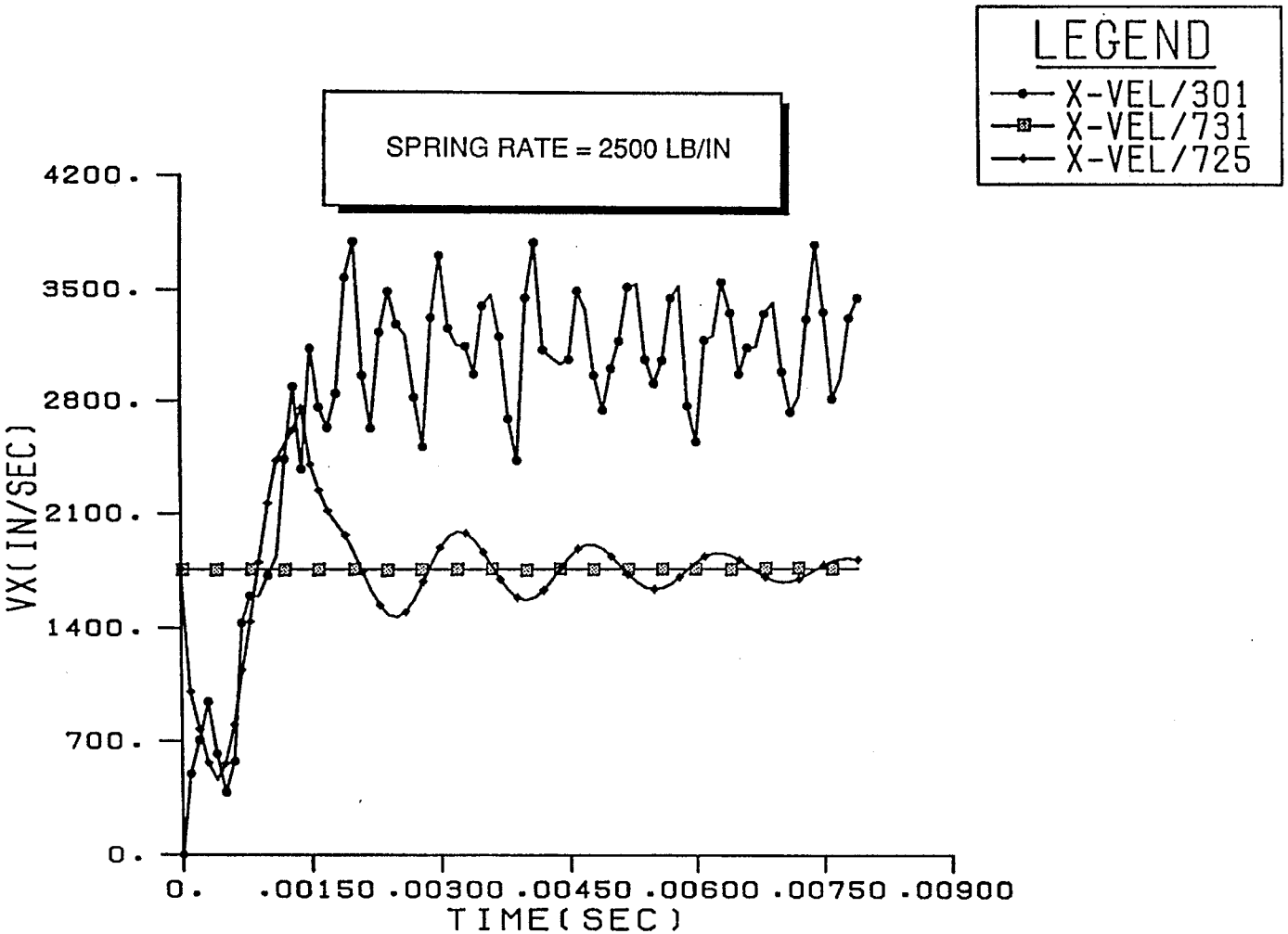
Figure 25:
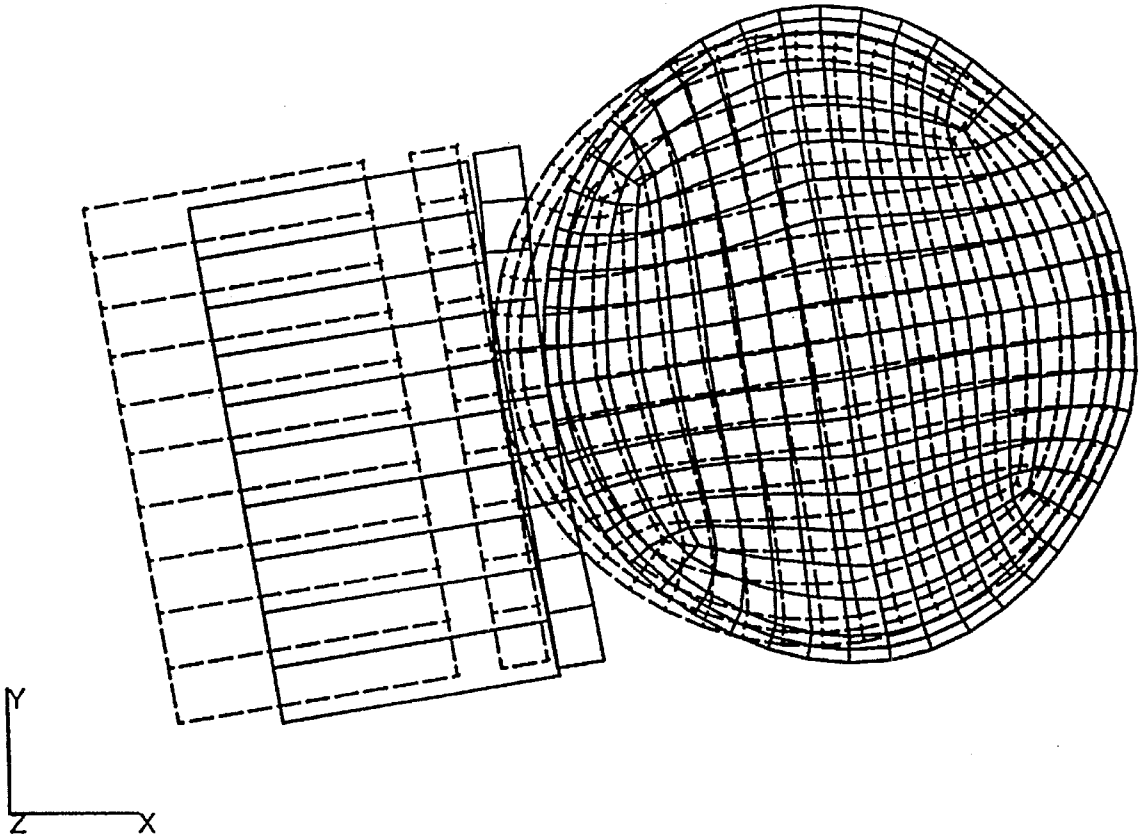
Figure 26:
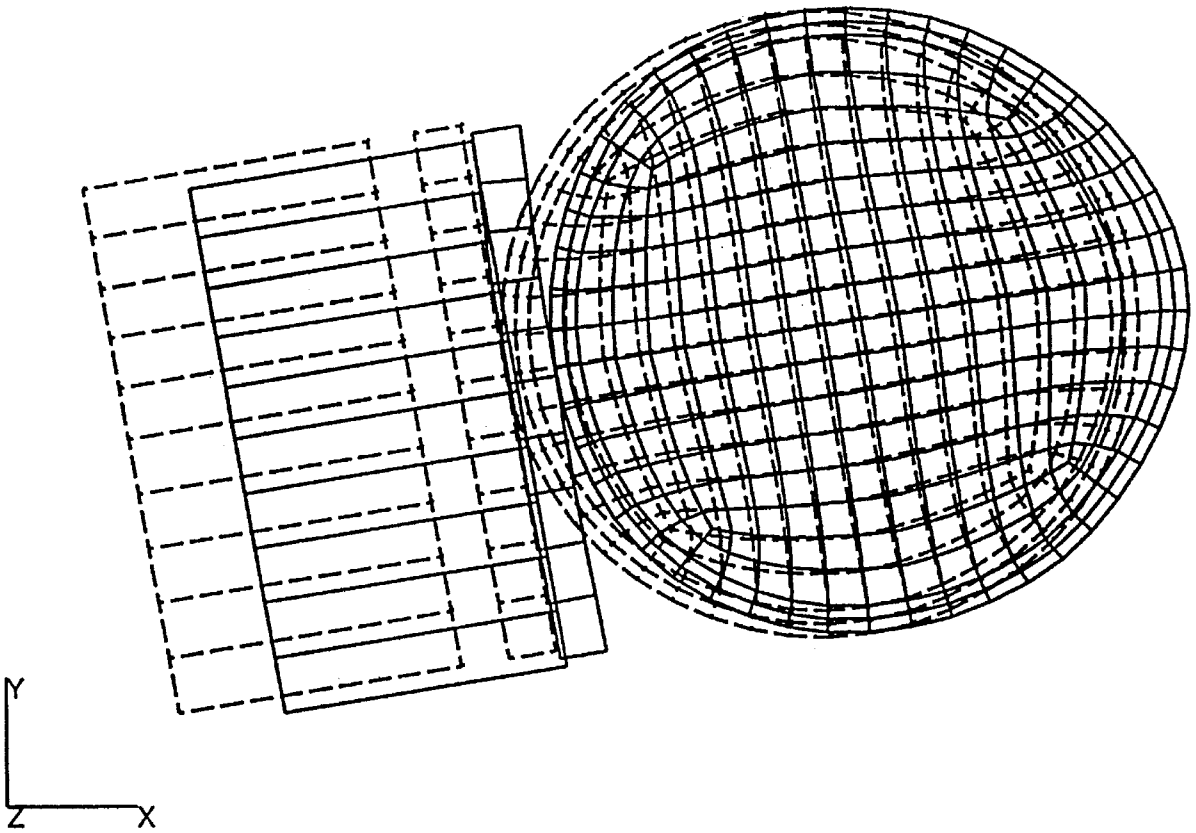
Figure 27:
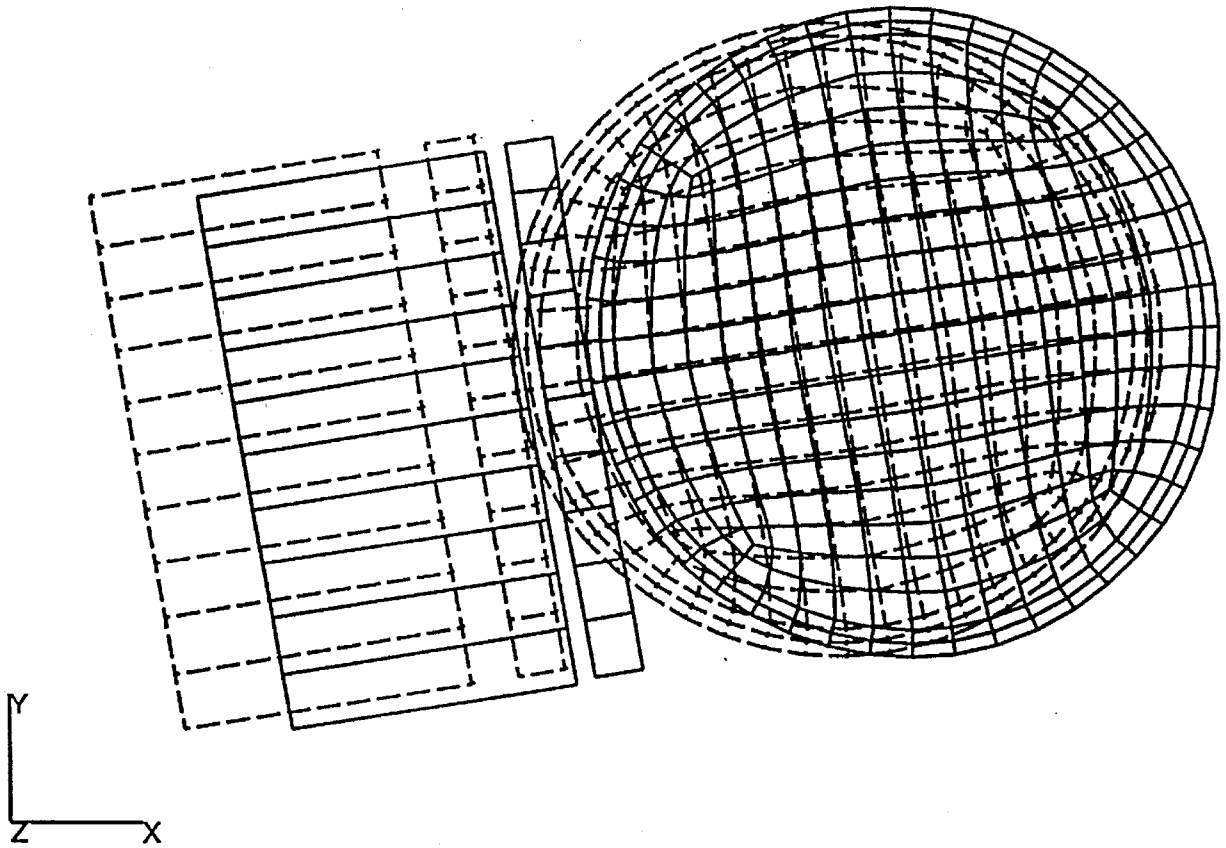
Figure 28:
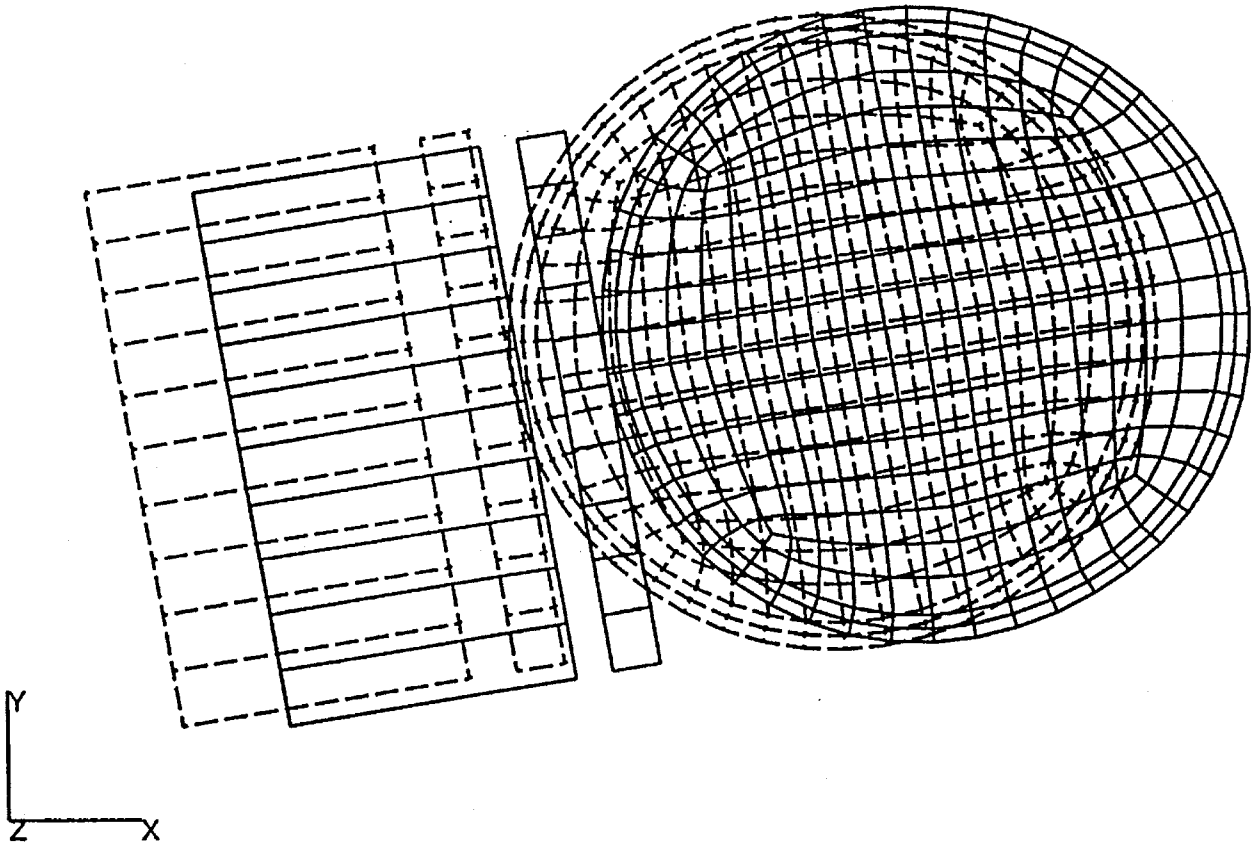
Figure 29:
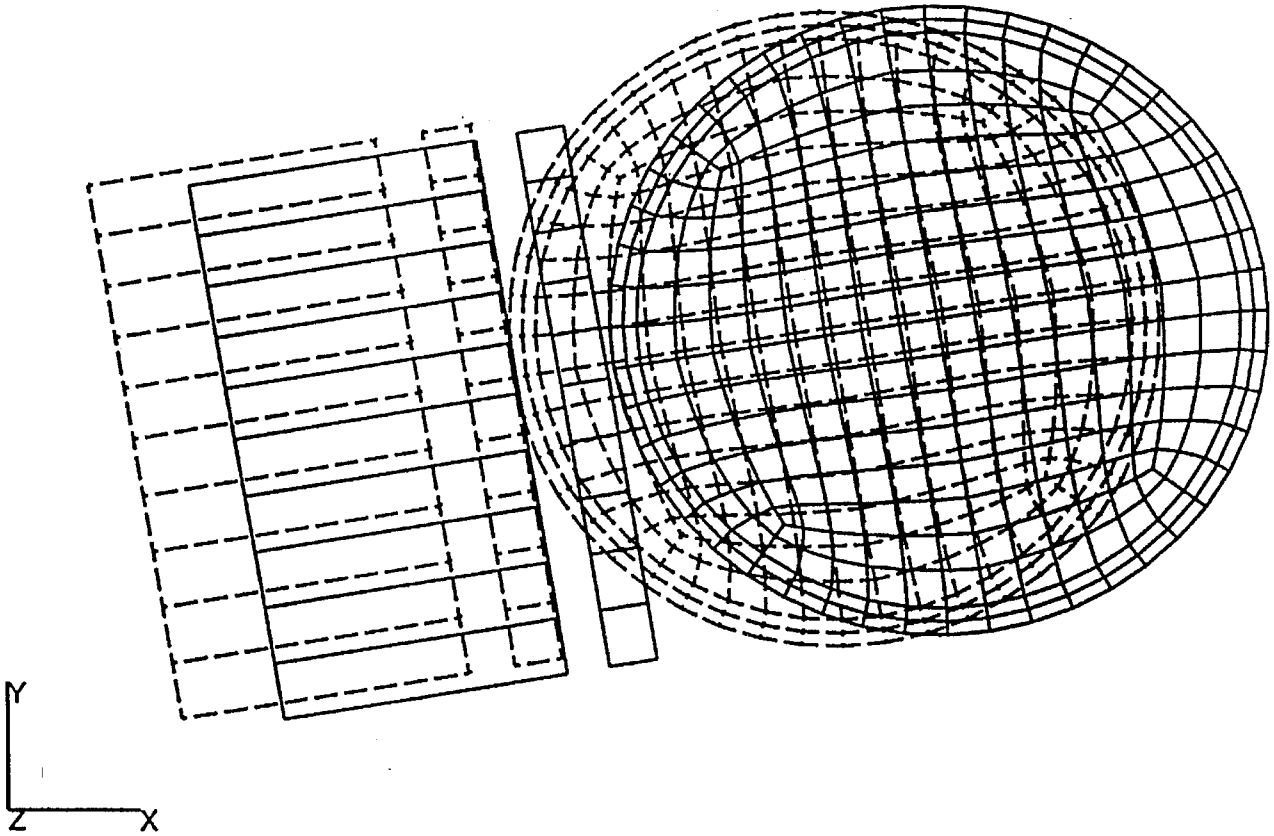
Figure 30:
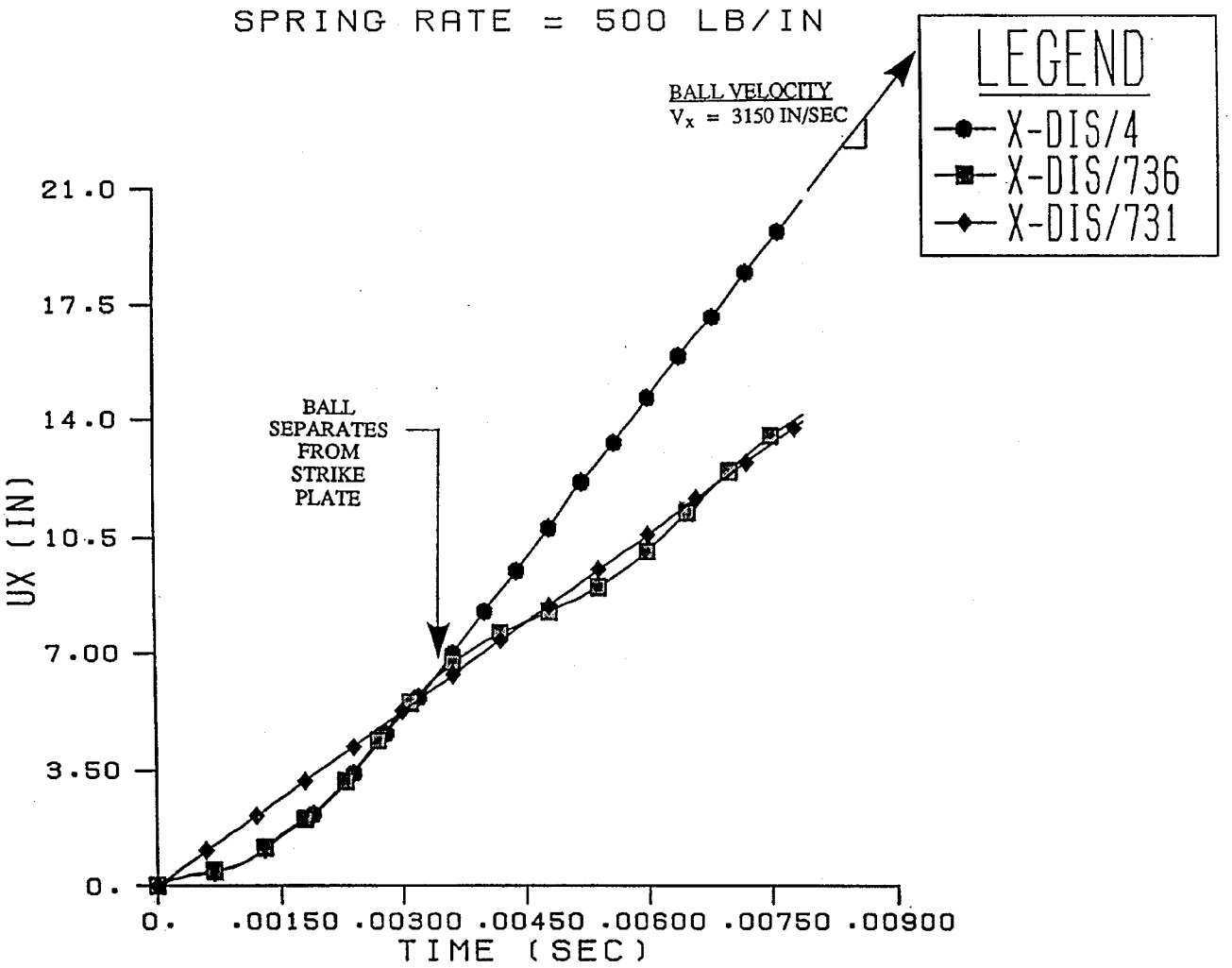
Figure 31:
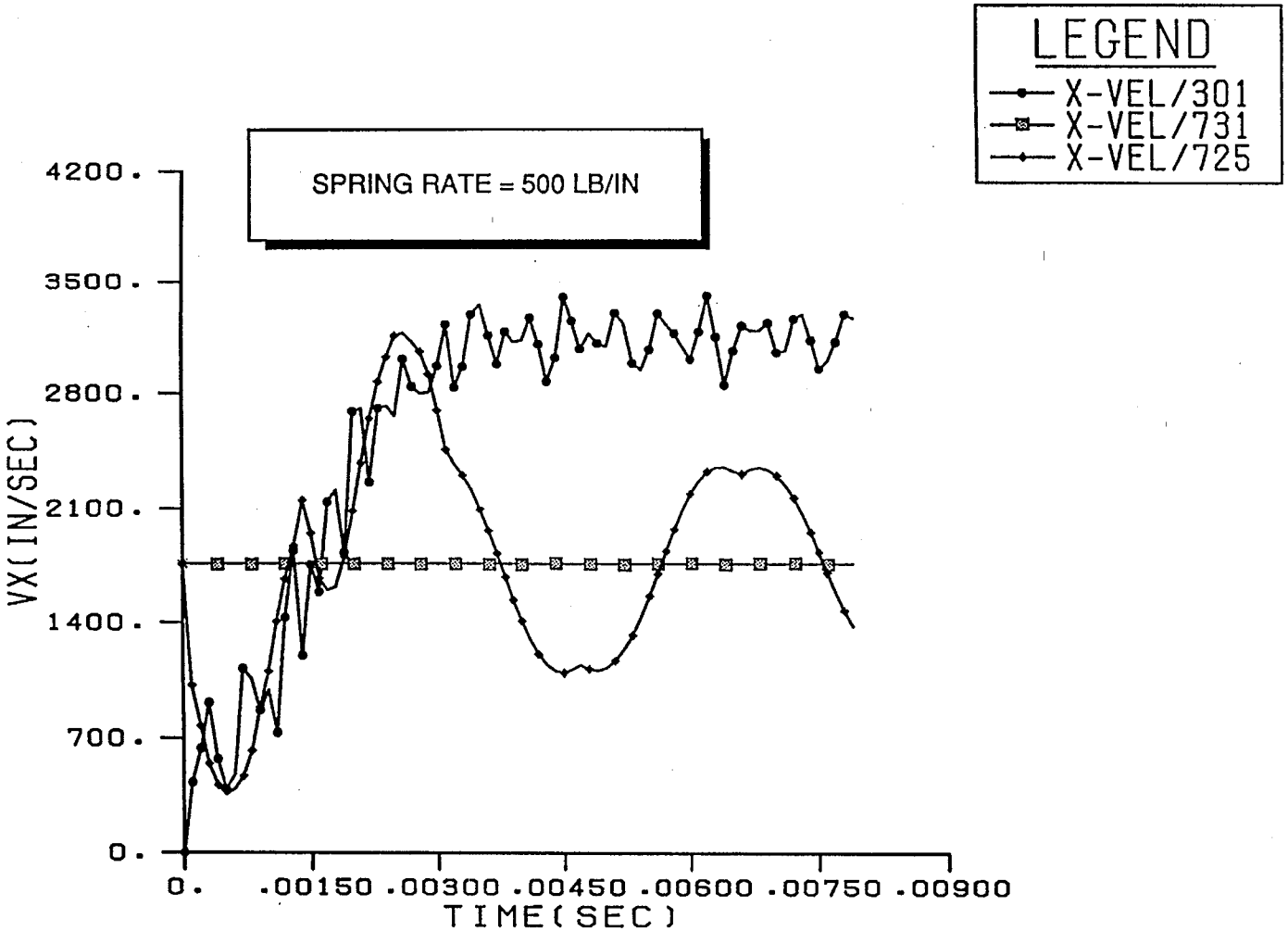
Figure 32:
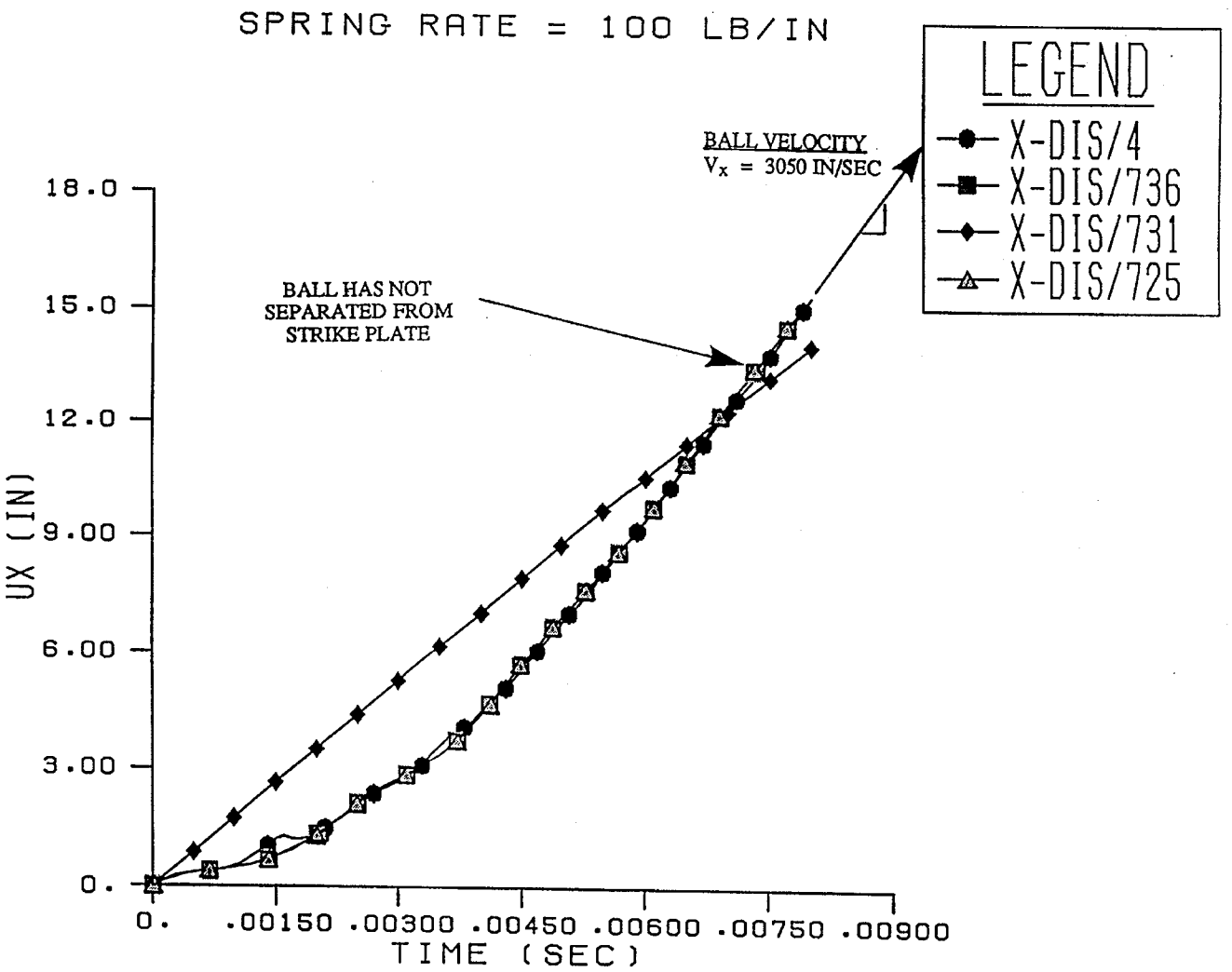
Figure 33:
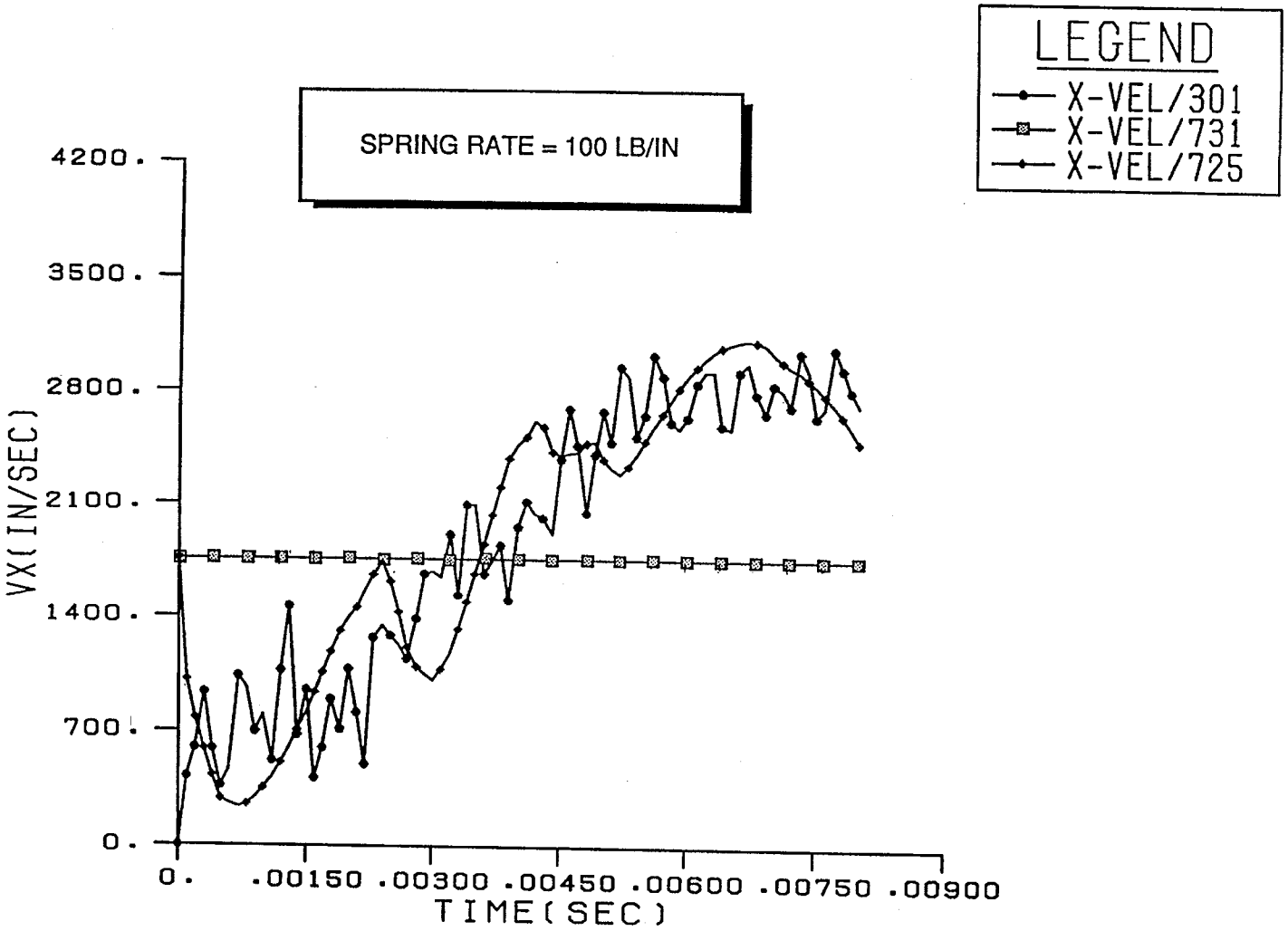

Referring to FIGS. 14–34, the FEM provides a means for calculating the most advantageous use of the tuning means of the present invention. For example, using different spring rates (C, in FIG. 13) or resilience of the hitting plates (B, in FIG. 13) of the present invention, FIG. 14 shows for the indicated spring rate, the calculated plots of golf club head, strike plate, and golf ball deflections versus time, the resulting average velocity of the ball, after separating from the strike plate and the elapsed time for the ball to leave the striking plate after being struck. The distance the ball will travel is directly proportional to its average velocity after separating from the strike plate. FIG. 15 shows for the indicated spring rate, the calculated plots of the resulting velocities of the golf club head, strike plate and golf ball versus time. FIGS. 16–18 schematically show the reaction of the ball and plate, as undeformed shape plots in dashed or broken lines, and deformed shape plots in solid lines, at various times, which serves to validate that reasonable and appropriate impact responses of the solids in contact have been simulated by analysis.

In the same manner, FIGS. 19–33 show results predictions for different spring rate configurations, thereby allowing the characteristics of golf club heads of the present invention to be calculated and adjusted, in accordance with the method of the present invention to thereby allow golf clubs to be more closely matched to the actual needs of a particular individual, both during manufacture, and after the club has been delivered to the individual.

Figure 34:
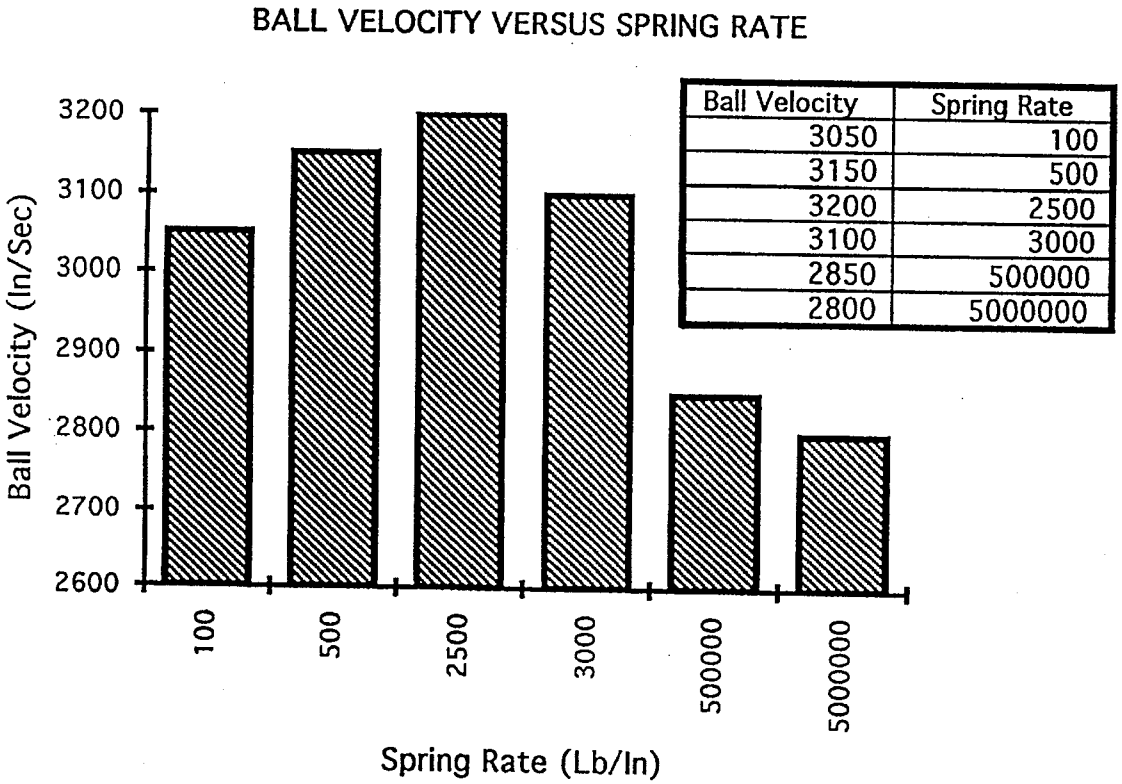
FIG. 34 is a schematic representational view of an analytical results summary bar chart plot of the ball velocities associated with varying strike plate support spring rates, utilizing the tuning method of the present invention.

FIG. 34 shows in graphic form the plot of the velocities of the ball versus the various spring rates used previously to show the preferred spring rate and the expected velocity of a golf ball struck by a club head ideally tuned, using the method of the present invention.

Those skilled in the art will appreciate that the above-described preferred embodiment is subject to numerous modifications and adaptations without departing from the scope and spirit of the invention. Therefore, it is to be understood that, within the scope of the appended claims, the invention may be practiced other than as specifically described herein.

What is claimed is:

1. A golf club head having a body and a hitting plate means, said golf club head being capable of being secured to a shaft, the improvement comprising:

said body having a front surface and a rear surface and said hitting plate means having a front face and a rear face;

at least one tuning element secured between and contacting said front face of said body and said rear face of said hitting plate means; and means for adjusting said at least one tuning element so as to selectively control the movement of said hitting plate means when said hitting plate means strikes a golf ball so as to control the release of said golf ball when it leaves said hitting plate.

2. The golf club head of claim 1 wherein said means for adjusting said at least one tuning element is comprised of a resilient means captured in at least one opening formed between the rear face of said hitting plate and said front surface of said body.

3. The golf club head of claim 2 wherein said at least one opening is a recessed opening formed to the rear face of said hitting plate means.

4. The golf club head of claim 3 wherein said biasing means is a plurality of belleville washers held on an adjustable means passing through an opening formed in said body, and said adjustable means is secured in a threaded opening formed to said rear face of said hitting plate means.

5. The golf club head of claim 2 wherein said at least one opening is a recessed opening formed in the front surface of said body; an external frame holding means is removably secured to said body for securing said hitting plate means in said recessed opening at the front surface of said body; and said biasing means is comprised of a plurality of tension strings captured in an internal frame held within said recessed opening at said front surface of said body.

6. The golf club head of claim 5 wherein said internal frame held within said recessed opening at the front of said body is U-shaped and said tension strings are adjustably and movably mounted in said internal frame.

7. The golf club head of claim 6, further including a plurality of guide means formed to said hitting plate means and said plurality of guide means are movably captured in a plurality of key means formed to said external frame holding means.

8. The golf club head of claim 5, further including a plurality of guide means formed to said hitting plate means and said plurality of guide means are movably captured in a plurality of key means formed to said external frame holding means.

9. The golf club head of claim 2, wherein said at least one opening is a recessed opening formed in the front surface of said body; an external frame holding means is removably secured to said body for securing said hitting plate means in said recessed opening at said front surface of said body; and said biasing means is captured in said recessed opening at said front surface of said body.

10. The golf club head of claim 9, further including a plurality of guide means formed to said hitting plate means and said guide means are movably captured in a plurality of key means formed to said external frame holding means.

11. The golf club head of claim 9 wherein said biasing means are a plurality of belleville washers held on a plurality of extending pin means formed in said recessed opening at the front surface of said body so as to coact with selected portions of said hitting plate means.

12. The golf club head of claim 9, further including a plurality of guide means formed to said hitting plate means, said guide means movably captured in a plurality of key means formed to said external frame holding means.

13. The golf club head of claim 2 wherein said at least one opening is a recessed opening formed in the front surface of said body; an external frame holding means is removably secured to said body for securing said hitting plate means in said recessed opening at the front surface of said body; and said body is hollow and includes a single internal chamber contained within the hollow body connected to said recessed opening at said front surface of said body.

14. The golf club head of claim 2 wherein said at least one opening is a recessed opening formed in the front surface of said body; an external frame holding means is removably secured to said body for securing said hitting plate means in said recessed opening at the front surface of said body; and wherein said body includes an opening passing entirely therethrough, connected to said recessed opening at said front surface of said body.

15. A golf club head having a body with a front surface and a rear surface, and a hitting plate having a front face and a rear face, the improvement comprising:

said body having a recessed opening at the front surface of said body;

an external frame holding means having a plurality of openings therein for the receipt of securing means to hold said hitting plate to said body so as to seal said hitting plate in said recessed opening at said front surface of said body, with said front face of said hitting plate positioned so as to be capable of striking a golf ball; and a plurality of high strength tension strings captured in an internal frame held within said recessed opening at said front surface of said body with said tension strings abutting against said rear face of said hitting plate for coacting with said hitting plate, whereby said tension strings may be separately adjusted so as to selectively control the movement of said hitting plate and a golf ball, when said hitting plate strikes said golf ball.

16. The golf club head of claim 15, further including a bulbous portion formed to said rear face of said hitting plate in contact with said tension strings, and a plurality of guide means formed to said hitting plate, said guide means movably captured in a plurality of keyways formed to said holding frame.

17. The golf club head of claim 16 wherein said body is hollow and includes a single internal chamber contained within the hollow body connected to said recessed opening at said front surface of said body.

18. The golf club head of claim 16 wherein said body includes an opening passing entirely therethrough, connected to said recessed opening at said front surface of said body.

19. A golf club head having a body with a front surface and a rear surface, and a hitting plate having a front face and a rear face, the improvement comprising:

said body having a recessed opening at the front surface of said body;

an external frame holding means having a plurality of openings therein for the receipt of securing means to hold said hitting plate in said recessed opening at said front surface of said body to seal said recessed opening, with said front face of said hitting plate positioned so as to be capable of striking a golf ball; and a plurality of separate biasing means captured on a plurality of holding means extending from said recessed opening at said front surface of said hollow body, with said plurality of separate biasing means abutting against selected portions of said rear face of said hitting plate for coacting with said hitting plate, whereby said plurality of separate biasing means may be separately adjusted so as to selectively control the movement of the selected portion of said hitting plate which it contacts and a golf ball, when said hitting plate strikes said golf ball.

20. The golf club head of claim 19 wherein said plurality of separate biasing means are a plurality of belleville washers held on a plurality of extending pin means formed to said hollow body so as to coact with the selected portions of said hitting plate.

21. The golf club head of claim 20 wherein said body is hollow and includes a single internal chamber contained within the hollow body connected to said recessed opening at said front surface of said body.

22. The golf club head of claim 20 wherein said body includes an opening passing entirely therethrough, connected to said recessed opening at said front surface of said body.

23. A method of tuning a golf club head comprising the steps of:

forming a golf club head body and a separate hitting plate with an opening therebetween;

tuning said golf club head by securing a preselected tuning element within said recessed opening between said golf club head body and said separate hitting plate so as to selectively control the release of a golf ball hit by said golf club head; and securing said hitting plate to said body with said preselected tuning element in contact with said golf club head body and said separate hitting plate.

24. The method of claim 23, including the further steps of forming a frame to fit around said opening to hold said separate hitting plate in said opening; forming said preselected tuning element as a plurality of tension strings and adjustably mounting said tension strings in an internal frame, and inserting said internal frame and said tension strings in said opening.

25. The method of claim 24, including the further steps of forming a plurality of guide means on said hitting plate, and forming a plurality of keyways in said holding frame to movably capture said guide means when mounted in said recessed opening.

26. The method of claim 23, including the further steps of forming said preselected tuning element as a plurality of belleville washers and forming a plurality of extending means to said opening, and mounting said plurality of belleville washers on said plurality of extending means so as to selectively coact with different portions of said hitting plate.

27. The method of claim 26, including the further steps of forming a frame to fit around said recessed opening to hold said hitting plate in said recessed opening; forming a plurality of guide means on said hitting plate, and forming a plurality of keyways in said frame to movably capture said guide means when mounted in said recessed opening.

28. A process for tuning a golf club head having a removable hitting plate, comprising the steps of:

calculating the resiliency of said hitting plate and a tuning means in contact with said hitting plate, in relationship to the resiliency of a golf ball to be struck by said hitting plate;

removing said hitting plate from said golf club head;

adjusting the resiliency of said tuning means; and securing said hitting plate back to said golf club head in contact with said adjusted tuning means to thereby change the resiliency of said hitting plate.

29. The process of claim 28 wherein said tuning means are a plurality of tension strings, and the resiliency of said tension strings are adjusted by replacing said tension strings with other tension strings.

30. The process of claim 28 wherein said tuning means are a plurality of belleville washers and the resiliency of said belleville washers are adjusted by replacing said belleville washers with other belleville washers.

* * * * *